US009291936B2

(12) United States Patent
Taniguchi et al.

(10) Patent No.: US 9,291,936 B2
(45) Date of Patent: Mar. 22, 2016

(54) IMAGE-FORMING APPARATUS WITH ELECTRO-CONDUCTIVE RESIN LAYER HAVING RESIN PARTICLES AND PROCESS CARTRIDGE

(71) Applicant: CANON KABUSHIKI KAISHA, Tokyo (JP)

(72) Inventors: Tomohito Taniguchi, Suntou-gun (JP); Takehiko Aoyama, Suntou-gun (JP); Taichi Sato, Numazu (JP); Noboru Miyagawa, Suntou-gun (JP); Masahiro Watanabe, Mishima (JP); Atsushi Uematsu, Fuji (JP); Yoshitaka Suzumura, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/315,686

(22) Filed: Jun. 26, 2014

(65) Prior Publication Data

US 2015/0003872 A1 Jan. 1, 2015

(30) Foreign Application Priority Data

Jun. 27, 2013 (WO) ..... PCT/JP2013/067712

(51) Int. Cl.
*G03G 15/02* (2006.01)
*G03G 9/097* (2006.01)

(52) U.S. Cl.
CPC ..... *G03G 15/0233* (2013.01); *G03G 9/09716* (2013.01); *G03G 9/09725* (2013.01)

(58) Field of Classification Search
CPC ..... G03G 9/08; G03G 9/0834; G03G 9/083; G03G 9/087; G03G 9/0836
See application file for complete search history.

(56) References Cited

U.S. PATENT DOCUMENTS 6,477,344 B1 * 11/2002 Asakura ..... G03G 15/161 399/101
7,811,734 B2 * 10/2010 Ogawa ..... B82Y 30/00 428/405
2006/0222982 A1 * 10/2006 Fujikawa ..... G03G 15/0907 430/106.1
2010/0135695 A1 6/2010 Mayuzumi et al.
2011/0305481 A1 * 12/2011 Taniguchi ..... G03G 15/0233 399/115
2013/0316282 A1 11/2013 Ishigami et al.

FOREIGN PATENT DOCUMENTS

JP 2003316112 A 11/2003
JP 2006107375 A 4/2006

(Continued)

*Primary Examiner* — Clayton E Laballe
*Assistant Examiner* — Victor Verbitsky
(74) *Attorney, Agent, or Firm* — Canon USA Inc. IP Division

(57) ABSTRACT

There are provided an image-forming apparatus that inhibit the occurrence of a longitudinal streak image attributed to a cleaning failure, and a process cartridge.

The image-forming apparatus and the process cartridge each have a charging member with a surface having a concavities derived from an opening of the bowl-shaped resin particle, and a protrusions derived from an edge of the opening of the bowl-shaped resin particle, the coverage ratio X1 of a surface of the toner with the silica fine particles is 50.0 area % or more and 75.0 area % or less, and when a theoretical coverage ratio of the toner by the silica fine particles is X2, a diffusion index represented by the formula 1 satisfies the formula 2:

$$\text{diffusion index} = X1/X2 \quad \text{(formula 1)}$$

$$\text{diffusion index} \geq -0.0042 \times X1 + 0.62 \quad \text{(formula 2)}$$

4 Claims, 11 Drawing Sheets

(56) References Cited

FOREIGN PATENT DOCUMENTS

| | | | |
|---|---|---|---|
| JP | 2008276026 | A | 11/2008 |
| JP | 2009175427 | A | 8/2009 |
| JP | 2011053429 | A | 3/2011 |
| JP | 2011-107375 | A | 6/2011 |
| JP | 2011-248353 | A | 12/2011 |
| JP | 2012-037875 | A | 2/2012 |
| JP | 2012-141386 | A | 7/2012 |
| JP | 2013-047754 | A | 3/2013 |
| JP | 2013-134447 | A | 7/2013 |

* cited by examiner

IMAGE-FORMING APPARATUS WITH ELECTRO-CONDUCTIVE RESIN LAYER HAVING RESIN PARTICLES AND PROCESS CARTRIDGE

TECHNICAL FIELD

The present invention relates to an image-forming apparatus and a process cartridge.

BACKGROUND ART

An image-forming apparatus using an electrophotographic method (hereinafter, referred to as an "image-forming apparatus") mainly includes, for example, an electrophotographic photosensitive member, a charging device, an exposure device, a developing device, a transfer device, a cleaning device, and a fixing device. Steps, such as charging, exposure, developing, and cleaning, are repeatedly performed.

The charging device is configured to charge a surface of the electrophotographic photosensitive member (hereinafter, also referred to as a "photosensitive member"). A contact charging method using a charging member in contact with a surface of the photosensitive member is often used. In this case, a roller-shaped charging member is preferably used.

Toner which has not transferred to a transfer material, such as paper, in a transfer step (hereinafter, also referred to as "residual toner") adheres to the surface of the photosensitive member, in some cases. To remove the residual toner from the surface of the photosensitive member and permit the photosensitive member to be used for the subsequent image formation process, a cleaning member, such as an elastic blade, used in a cleaning step is often in contact with the surface of the photosensitive member.

The residual toner that has not been removed with the cleaning member affects the subsequent image formation process and can cause a phenomenon in which the quality of an image is reduced. The phenomenon is commonly referred to as a "cleaning failure". When the phenomenon occurs, a longitudinal streak-like image (hereinafter, referred to as a "longitudinal streak image") on a solid white background often emerges.

PTL 1 discloses a charging member configured to suppress the occurrence of the cleaning failure by inhibiting the fixation of corona products to a surface of a photosensitive member.

CITATION LIST

Patent Literature

PTL 1 Japanese Patent Laid-Open No. 2012-037875

In recent years, image-forming apparatuses have been required to have higher speeds and have been used in various environments. The inventors have conducted studies and have found that a higher speed of an image-forming apparatus and image formation in a low-temperature and low-humidity environment cause an increase in the stick-slip of a cleaning member and is thus easily cause a cleaning failure.

That is, the inventors have recognized that a higher speed of an image-forming apparatus and a change in usage environment can cause a longitudinal streak image, which has not been formed in the past, to emerge and that the inhibition of the cleaning failure is an issue to be solved in order to stably form an image.

The present invention is directed to providing an image-forming apparatus that inhibits the occurrence of a longitudinal streak image due to a cleaning failure and a process cartridge detachably attachable to the image-forming apparatus.

SUMMARY OF INVENTION

According to one aspect of the present invention, there is provided an image-forming apparatus comprising:

a photosensitive member, charging means for charging the photosensitive member with a charging member, exposure means for forming an electrostatic latent image on a surface of the charged photosensitive member, developing means for supplying the photosensitive member on which the electrostatic latent image is formed with a toner to form a toner image on the surface of the photosensitive member, and cleaning means for recovering a residual toner before the charging means, wherein:

the charging member comprises an electro-conductive substrate and an electro-conductive resin layer, the electro-conductive resin layer comprises a binder resin C and a bowl-shaped resin particle, and a surface of the charging member has concavities derived from an opening of the bowl-shaped resin particle, and protrusions derived from an edge of the opening of the bowl-shaped resin particle, and wherein:

the toner comprises:

toner particles, each of which contains a binder resin T and a colorant, and inorganic fine particles, the inorganic fine particles are silica fine particles, the toner contains the silica fine particles in an amount of 0.40 parts by mass or more and 1.50 parts by mass or less based on 100 parts by mass of the toner particles, the silica fine particles have been treated with 15.0 parts by mass or more and 40.0 parts by mass or less of a silicone oil based on 100 parts by mass of a silica raw material, the fixation ratio (%) of the silicone oil based on the amount of carbon is 70% or more, the coverage ratio X1 of a surface of the toner by the silica fine particles as determined by X-ray photoelectron spectrometer (ESCA), is 50.0 area % or more and 75.0 area % or less, and when a theoretical coverage ratio of toner by the silica fine particles is X2, a diffusion index represented by the following formula 1 satisfies the following formula 2:

$$\text{diffusion index} = X1/X2 \quad \text{(formula 1)}$$

$$\text{diffusion index} \geq -0.0042 \times X1 + 0.62 \quad \text{(formula 2)}$$

Further features of the present invention will become apparent from the following description of exemplary embodiments with reference to the attached drawings.

DESCRIPTION OF EMBODIMENTS

Figure 1A:
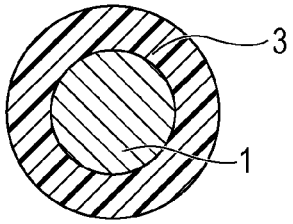
FIGS. 1A to 1D illustrate cross-sectional views of a charging member (roller shape) according to the present invention.
Figure 1B:
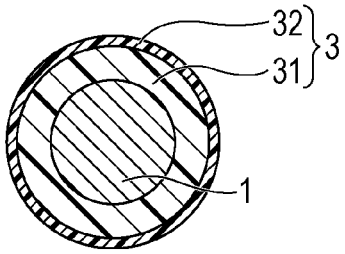
Figure 1C:
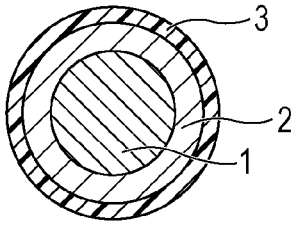
Figure 1D:
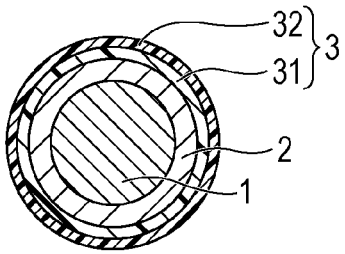

The inventors have conducted intensive studies on a mechanism by which the effect of inhibiting the occurrence of a cleaning failure is provided in the foregoing image-forming apparatus including the charging member and the toner or in the process cartridge. The mechanism will be described in detail below on the basis of the examination results with a blade-shaped cleaning member as an example.

The inventors have closely observed a surface of the cleaning member in contact with a photosensitive member when the cleaning failure occurs and have observed that local vibration, i.e., micro-stick-slip, occurs at several longitudinal positions of the cleaning member and that the toner slips from the positions where the stick-slip occurs. It has also been found that the stick-slip occurs easily at a position where an aggregated residual toner collides with the cleaning member.

Here, the inventors have observed the behavior of the surface of the cleaning member when no residual toner has been present. A photosensitive member was charged using a conventional charging member described in PTL 1 as a charging member. The rotational speed of the photosensitive member was gradually increased. It was found that a higher rotational speed of the photosensitive member was liable to cause an increase in the number of the positions where the stick-slip occurred on the surface of the cleaning member and an increase in slip length.

The inventors prepared a conventional toner that had been subjected to a transfer step by the use of an image-forming apparatus using the toner. In other words, the toner (hereinafter, also referred to as an "aggregated toner") was prepared separately as an aggregated toner in which a residual toner was simulatively reproduced. The aggregated toner was supplied to the cleaning member in contact with the photosensitive member that was rotating at a high speed. The toner was slipped from the positions where the stick-slip occurred, thereby forming a streak of the toner on the surface of the photosensitive member after the passage of the cleaning member. When the rotation was further continued, the positions where the stick-slip occurred were increased, and the streaks of the toner were increased.

Next, a charging member according to the present invention was used in place of the conventional charging member. First, a surface of the cleaning member was observed without the presence of the aggregated toner. The stick-slip, which was observed in the conventional charging member, was not observed. Thereafter, the foregoing aggregated toner was supplied to the cleaning member in the same way as above. Although no streak of the toner was formed immediately after the supply, a streak of the toner was formed a short while after the supply.

The inventors were conducted the foregoing study with a toner according to the present invention. An attempt was made to simulatively reproduce a residual toner in the same way as the foregoing aggregated toner. However, it was found that the toner according to the present invention does not easily form an aggregated toner even through a transfer step. Meanwhile, a toner, which had been subjected to the transfer step, according to the present invention was prepared.

Next, the photosensitive member was rotated at a high speed while being charged with the charging member according to the present invention, in the same way as above. The toner, which had been subjected to the transfer step, according to the present invention was supplied to the cleaning member. The results demonstrated that the stick-slip was not observed and that a streak of the toner was not observed.

From the results of the series of studies, the inventors speculate the following mechanism for the inhibition of the cleaning failure by the use of the charging member according to the present invention and the toner according to the present invention.

As illustrated in FIGS. 2A to 2D, the surface of the charging member according to the present invention has a "concavity derived from an opening of a bowl-shaped resin particle" and a "protrusion derived from the opening edge of the bowl-shaped resin particle". When the charging member having the uneven shape comes into contact with the photosensitive member, the protrusion derived from the opening comes into contact with the photosensitive member. The concavity has a space between the concavity and the photosensitive member. The protrusion can be elastically deformed as illustrated in FIGS. 8A to 8D. It is speculated that the charging member absorbs vibration that increases with increasing rotational speed of the photosensitive member to stabilize the high-speed rotation of the photosensitive member, so that it is possible to inhibit the local occurrence of the stick-slip of the cleaning member.

The aggregated toner subjected to the transfer step is often subjected to compaction and a strong electric field, so that the aggregated toner has strong adhesion to the surface of the photosensitive member. In other words, the aggregated toner has low releasability from the photosensitive member. Such an aggregated toner makes considerable physical impact upon colliding with the cleaning member. It is speculated that when the aggregated toner reaches a position where the stick-slip occurs, the stick-slip is increased by the physical impact, thereby inducing the cleaning failure.

A cleaning member in a state in which the vibration that causes the stick-slip is inhibited by the charging member according to the present invention is capable of removing the aggregated toner from the surface of the photosensitive member. Thus, the cleaning failure does not occur immediately after the supply of the aggregated toner. However, the removed aggregated toner often remains on the surface of the cleaning member. The aggregated toner particles that come one after another accumulate and reaggregate repeatedly in the vicinity of the surface of the cleaning member. The accumulated and reaggregated toner has further increased adhesion to the surface of the photosensitive member and is easily lodged on the surface of the photosensitive member. It is speculated that the accumulated and reaggregated toner induces the stick-slip of the cleaning member to cause the cleaning failure to occur with time.

In the toner according to the present invention, the state of silica fine particles on surfaces of particles of the toner is precisely controlled to significantly reduce the aggregability of the toner. This significantly reduces the formation of the aggregated toner and the accumulation and the reaggregation of the toner in the vicinity of the surface of the cleaning member after the transfer step. The toner having controlled aggregability as described above is combined with the cleaning member whose vibration, which induces the occurrence of the stick-slip, is inhibited with the charging member, thereby markedly inhibiting the stick-slip during the high-speed rotation of the photosensitive member. This seemingly enables satisfactory cleaning properties to be continuously maintained even if the photosensitive member is rotated at a high speed.

Figure 15:
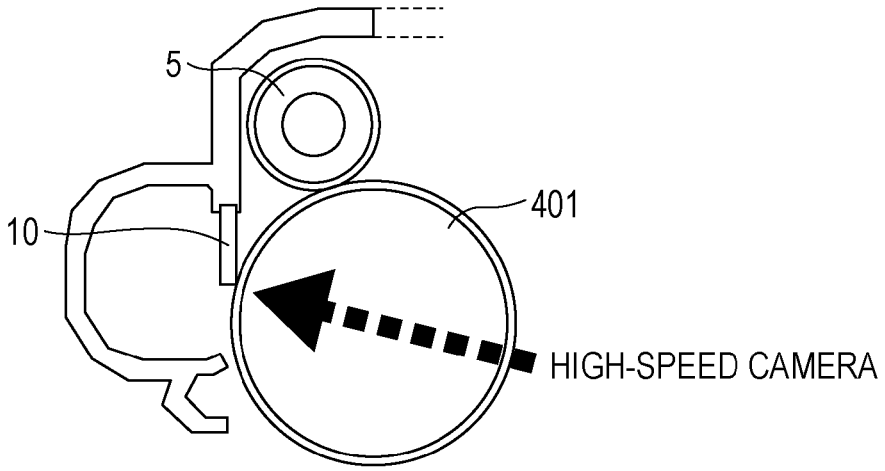
FIG. 15 is a schematic drawing of an apparatus for observing a surface of a cleaning member (blade shape) according to the present invention.

Observation of the vicinity of the surface of the cleaning member was performed with an apparatus illustrated in FIG. 15. In FIG. 15, a photosensitive member 401 includes a 5-μm-thick ITO film on a surface of a glass drum and only a 17-μm-thick charge transport layer, which is used for the photosensitive member, on the outer periphery thereof. As illustrated in FIG. 15, a charging member 5 and a cleaning member 10 are in contact with the photosensitive member. The observation was performed with a high-speed camera from the opposite side of the contact portion of the cleaning member 10.

A discussion on the inhibition of the formation of the aggregated toner by the precise control of the state of the silica fine particles on the surface of the toner will be described in detail below. The aggregated toner slipped through the cleaning member has high adhesion and thus is easily fixed to the surface of the charging member, affecting a charging step. This is commonly referred to as a "smudge on a charging member". When the smudge on the charging member proceeds, an anomalous discharge due to the smudge is caused. When this phenomenon occurs, a dot-like image (hereinafter, also referred to as a "dot image") often emerges on a halftone image.

The inventors conducted intensive studies on the smudge on the charging member with the observation apparatus and found that the aggregated toner is easily fixed to the charged surface, reduces the rotational properties of the charging member, and easily causes the micro-slip of the charging member.

A portion where the aggregated toner is fixed to the surface of the charging member is easily lodged on the photosensitive member, compared with a portion where the toner is not fixed. In the fixed portion, a small strain occurs on the surface of the charging member at the time of the release of the contact state between the charging member and the photosensitive member. Upon releasing the strain, the micro-slip occurs. The aggregated toner is further rubbed by the micro-slip. This seemingly extends the fixation, thereby causing the smudge of the charging member to proceed.

As described above, the charging member according to the present invention includes the protrusion derived from the opening of the bowl-shaped resin particle. The protrusion comes into contact with the photosensitive member. In this case, the degree of lodging on the photosensitive member is controlled by the protrusion.

When the aggregated toner reaches the protrusion, the aggregated toner is subjected to a significantly low pressure, compared with the conventional charging member described in Japanese Patent Laid-Open No. 2012-037875, because the protrusion is elastically deformed as described above. It was observed that the progression of the fixation of the aggregated toner to the protrusion tended to be suppressed. However, once the aggregated toner adhered to the protrusion, the aggregated toner was not easily detached from the protrusion and caused the micro-slip. Ultimately, the aggregated toner grew to a smudge having a size that affects the charging step.

In the toner according to the present invention, large amounts of a toner slipping through the cleaning member and inorganic fine particles (hereinafter, also referred to as "toner components") are present. While the toner components adhered temporarily to the protrusion of the charging member according to the present invention, no micro-slip occurred at the time of the release of contact, and no extension of the fixation of the toner was observed.

The inventors speculate the following mechanism by which the foregoing phenomenon occurs.

In the toner according to the present invention, the state of the silica fine particles on the surface of the toner is precisely controlled. In particular, a silicone oil adheres to surfaces of the inorganic fine particles. The coverage of the toner particles is specified. The toner components generated from the toner adheres just temporarily without being fixed to the protrusion of the charging member according to the present invention. The toner components according to the present invention temporarily adhering to the protrusion serve as spacers between the charging member according to the present invention and the photosensitive member. This seemingly inhibits the micro-slip between the photosensitive member and the charging member and permits stable rotational properties to be maintained at a higher speed.

The charging member according to the present invention is elastically deformed at the time of contact with the photosensitive member because of the uneven shape derived from the bowl-shaped resin particle. Furthermore, the elastic deformation is recovered by its reaction at the time of the release of the contact. The toner components adhering to the protrusion are easily detached by a force to recover the deformation (hereinafter, also referred to as a "restoring force"). This phenomenon inhibits the fixation of the toner components to the protrusion of the charging member. Thus, it is speculated that the toner components adhere successively to the surface of the charging member, so that it is possible to achieve the inhibition of the micro-slip and the stabilization of the driven rotation.

The series of studies described above leads the inventors to draw the following conclusion about a mechanism by which the effects according to the present invention, i.e., the effects of inhibiting the cleaning failure and the smudge on the charging member, are provided.

As described above, the charging member according to the present invention inhibits the stick-slip of the cleaning member, and the toner according to the present invention significantly reduces the aggregability of toner particles. A combination of the charging member according to the present invention and the toner according to the present invention markedly increases the effect of inhibiting the local occurrence of the stick-slip of the cleaning member, thereby inhibiting the occurrence of the cleaning failure.

Furthermore, the inhibition of the stick-slip of the cleaning member enables the toner components subjected to the cleaning step to be uniformly supplied to the surface of the charging member. The control of the adhesion of the toner components to the surface of the elastically deformable charging member according to the present invention results in marked inhibition of the micro-slip of the charging member and marked improvement in the stability of the driven rotation. This leads to the inhibition of the smudge on the charging member.

The inventors speculate that the improvement in the stability of the driven rotation enhances the effect of inhibiting the stick-slip of the cleaning member.

Toner

The inventors believe that in order to achieve the inhibition of the occurrence of the cleaning failure and the inhibition of the smudge on the charging member, the toner is required to satisfy the following four requirements.

(1) Difficulty in Embedding the Inorganic Fine Particles (Hereinafter, Also Referred to as an "External Additive") on the Surfaces of the Toner in the Toner.

If the external additive is embedded in the toner, the releasability of the toner and the foregoing spacer effect imparted by the external additive cannot be provided.

(2) Releasability of Toner

This results in the inhibition of the formation of the aggregated toner and the inhibition of the fixation of the toner components to the surface of the charging member.

(3) Lubricity of Toner

This facilitates the change of the toner components adhering to the surface of the charging member.

(4) Disaggregation Properties of Toner

This results in the inhibition of the formation of the aggregated toner.

To achieve requirements (1) to (4), the inventors specified the surface properties of the silica fine particles, which serve as an external additive according to the present invention, and the state of the externally added silica fine particles present on the toner surface.

Embodiments of the present invention will be described in detail below. Regarding the toner according to the present invention, the "surface properties of the silica fine particles" are specified as described below.

The toner according to the present invention includes toner particles each containing a binder resin and a colorant; and inorganic fine particles. Hereinafter, the binder resin contained in the toner particles is also referred to as "binder resin T".

In the present invention, the inorganic fine particles are silica fine particles, and the toner contains the silica fine particles in an amount of 0.40 parts by mass or more and 1.50 parts by mass or less based on 100 parts by mass of the toner particles. Preferably, the toner contains the silica fine particles in an amount of 0.50 parts by mass or more and 1.30 parts by mass or less based on 100 parts by mass of the toner particles.

The content of the silica fine particles is controlled to the range described above, thereby enhancing the releasability of the toner and inhibiting the embedding of the external additive in the toner. This results in the inhibition of the occurrence of the cleaning failure and the smudge on the charging member.

A content of the silica fine particles of less than 0.40 parts by mass results in insufficient releasability of the toner, thus causing the cleaning failure.

In the toner according to the present invention, the silica fine particles have been treated with 15.0 parts by mass or more and 40.0 parts by mass or less of a silicone oil based on 100 parts by mass of a silica raw material. The fixation ratio (%) of the silicone oil based on the amount of carbon is 70% or more.

Here, the fixation ratio of the silicone oil based on the amount of carbon corresponds to the amount of silicone oil molecules chemically bound to the surface of the silica raw material.

In the silica fine particles used for the toner according to the present invention, the number of parts of the silicone oil used for the treatment and the fixation ratio are controlled to the range described above, thereby enabling the aggregability and the friction coefficient between the silica fine particles to be controlled to ranges necessary for the present invention. Furthermore, the same properties can be imparted to the toner including the silica fine particles externally added, thus easily improving the effect described in item (2). The inventors speculate the following mechanism by which the effects are provided.

It is commonly known that an increase in the number of parts of a silicone oil added to a silica raw material improves the releasability from the developing member because of the low surface energy of silicone oil molecules. The affinity between silicone oil molecules causes the degradation of the releasability or the aggregability between the silica fine particles and causes an increase in friction coefficient between the inorganic fine particles. In the present invention, the silica fine particles are characterized by a relatively large number of parts of the silicone oil used for the treatment and a high fixation ratio. Such silica fine particles have an increased friction coefficient without degrading the aggregability between the silica fine particles. The inventors believe that the degradation of the aggregability is reduced by fixing ends of the silicone oil molecules to the surface of the silica raw material. This results in the inhibition of the occurrence of the aggregated toner described above and the inhibition of the occurrence of the cleaning failure.

The influence of the silica fine particles on the surface of the toner when the silica fine particles are externally added to the toner will be described below. When the toner particles are in contact with each other, the contact between the silica fine particles present on the surfaces of the toner particles is dominant within the range of the coverage ratio X1 , which will be described below, of the toner surface with the silica fine particles; hence, the toner is strongly affected by the properties of the silica fine particles. Thus, the toner according to the present invention has an increased friction coefficient between the toner particles without degrading the aggregability between the toner particles, thereby enabling the effects described in items (2) and (3) to be simultaneously provided. This results in the inhibition of the occurrence of the aggregated toner and the inhibition of the stick-slip of the cleaning member. Furthermore, it is possible to facilitate the change of the toner components on the surface of the charging member, thereby inhibiting the smudge on the charging member.

In the case where the number of parts of the silicone oil used for the treatment is less than 15.0 parts by mass, a sufficient friction coefficient cannot be obtained, thus reducing the circulating properties of the toner. In the case where the number of parts of the silicone oil used for the treatment is more than 40.0 parts by mass, while a sufficient friction coefficient is obtained, it is difficult to control the fixation ratio to an appropriate range. The aggregability between the silica fine particles is degraded, thus failing to provide the effect described in item (4).

In the case where the fixation ratio of the silicone oil based on the amount of carbon is less than 70%, the aggregability between the silica fine particles is degraded, failing to provide the effect described in item (4). Thus, the cleaning failure occurs.

The number of parts of the silicone oil used for the treatment of the silica fine particles is more preferably 17.0 parts by mass or more and 30.0 parts by mass or less based on 100 parts by mass of the silica raw material. The fixation ratio (%) of the silicone oil based on the amount of carbon is more preferably 90% or more. In this case, the foregoing effects are enhanced.

In the toner according to the present invention, the "state of the externally added silica fine particles" is specified as described below.

In the toner according to the present invention, the coverage ratio X1 of a surface of the toner by the silica fine particles, as determined by X-ray photoelectron spectrometer (ESCA), is 50.0 area % or more and 75.0 area % or less. The toner used in the present invention is characterized in that when a theoretical coverage ratio of the toner by the silica fine particles is X2, a diffusion index defined by the following formula 1 satisfies the following formula 2:

$$\text{diffusion index}=X1/X2 \quad \text{(Formula 1)}$$

$$\text{diffusion index}\geq -0.0042\times X1+0.62 \quad \text{(formula 2)}$$

The coverage ratio X1 may be calculated from the ratio of the detected intensity of elemental silicon when the toner is measured by ESCA to the detected intensity of elemental silicon when the silica fine particles alone are measured. The coverage ratio X1 indicates the ratio of the area of the surfaces of the toner particles actually covered with the silica fine particles to the surface area of the toner particles.

When the coverage ratio X1 is 50.0 area % or more and 75.0 area %, the toner can be controlled so as to have satisfactory flowability and chargeability during an endurance test. When the coverage ratio X1 is less than 50.0 area %, the toner does not have sufficient disaggregation properties described below. Thus, the flowability is degraded under the foregoing strict evaluation conditions because of the degradation of the toner. The releasability from the developing member is not sufficient, thus failing to remedy an endurance-standing problem.

The theoretical coverage X2 with the silica fine particles is calculated from the following formula 4 using the number of parts of the silica fine particles based on 100 parts by mass of the toner particles, the particle diameters of the silica fine particles, and so forth. This indicates the proportion of the area of the surfaces of the toner particles that can be theoretically covered.

$$\text{theoretical coverage } X2(\text{area }\%)=3^{1/2}/(2\pi)\times(dt/da)\times(\rho t/\rho a)\times C\times 100 \quad \text{(formula 4)}$$

where da: the number-average particle diameter (D1) of the silica fine particles dt: the weight-average particle diameter (D4) of the toner ρa: the true specific gravity of the silica fine particles ρt: the true specific gravity of the toner C: the mass of the silica fine particles/the mass of the toner (The subsequently described content of the silica fine particles is used as C.)

The physical significance of the diffusion index represented by the formula 1 is described below.

The diffusion index indicates the divergence between the measured coverage ratio X1 and the theoretical coverage X2. The degree of this divergence is believed to indicate how many the silica fine particles are staked into two or three layers in the vertical direction from the surfaces of the toner particles. Ideally, the diffusion index is 1. In this case, the coverage ratio X1 is matched with the theoretical coverage X2, and two or more layers of the silica fine particles are not present at all. When the silica fine particles are present on the toner surface in the form of aggregated secondary particles, a divergence arises between the measured coverage and the theoretical coverage, thus resulting in a lower diffusion index. In other words, the diffusion index indicates the amount of the silica fine particles present in the form of secondary particles.

In the present invention, it is important that the diffusion index is in the range indicated by the formula 2. This range is believed to be larger than that of toners produced by conventional techniques. A large diffusion index indicates that among the silica fine particles on the surfaces of the toner particles, a small amount of the silica fine particles is present in the form of secondary particles, and a large amount of the silica fine particles is present in the form of primary particles. As described above, the upper limit of the diffusion index is 1.

The inventors found that when both the coverage ratio X1 and the diffusion index satisfy the range indicated by the formula 2, the toner has significantly improved disaggregation properties upon the application of pressure.

Hitherto, it has been believed that the disaggregation properties of the toner are improved by the external addition of a large amount of an external additive having a small particle diameter of about several nanometers to increase the coverage ratio X1 . Studies conducted by the inventors demonstrated that when the disaggregation properties of toners having the same coverage ratio X1 and different diffusion indices were measured, there was a difference in disaggregation properties therebetween. It was also found that when the disaggregation properties were measured under pressure, a significant difference was observed. In particular, the inventors believe that the behavior of the toner in a state under pressure, which is typified by a transfer step, is reflected in the disaggregation properties of the toner under pressure. Thus, the inventors believe that in order to closely control the disaggregation properties of the toner under pressure, the diffusion index is very important in addition to the coverage ratio X1 .

The inventors speculate the following reason the toner has satisfactory disaggregation properties when both the coverage ratio X1 and the diffusion index satisfy the range indicated by the formula 2. When the toner is present in a narrow, high-pressure place, such as a blade nip, the inventors believe that it is attributed to the fact that the toner particles easily enter into an "interlocked" state in such a manner that the particles of the external additive present on the surfaces of the toner particles do not collide with one another. At this time, when a large number of silica fine particles are present in the form of secondary particles, the influence of interlocking is excessively increased. It is thus difficult to rapidly disaggregate the toner particles.

In particular, in the case where the toner has degraded, the silica fine particles present in the form of primary particles are buried in the surfaces of the toner particles, reducing the flowability of the toner. At that time, the influence of interlocking between silica fine particles which are not buried and which are present in the form of secondary particles is presumably increased to degrade the disaggregation properties of the toner. In the toner according to the present invention, most of the silica fine particles are present in the form of primary particles; hence, even if the toner has degraded, interlocking between the toner particles is less likely to occur. Even in the case where the toner is subjected to rubbing in a transfer step or the like, the toner is easily disaggregated into individual particles. That is, the "disaggregation properties of the toner" described in item (4), which is difficult to improve only by the control of the coverage ratio X1 in the related art, can be markedly improved.

Furthermore, the inventors found that when both the coverage ratio X1 and the diffusion index satisfy the range indicated by the formula 2, the degree of progress of the degradation of the toner is greatly improved. The reason for this is presumably that in the case where the silica fine particles on the surfaces of the toner particles are present in the form of primary particles, even if the toner particles come into contact with each other, the silica fine particles are less likely to come into contact with each other, and a pressure applied to the silica fine particles is reduced. That is, the effect described in item (1) is provided.

The boundary line of the diffusion index in the present invention is a function of the coverage ratio X1 as a variable in the coverage ratio X1 range of 50.0 area % or more and 75.0 area % or less. The function was empirically obtained from a phenomenon in which when the coverage ratio X1 and the diffusion index are determined by changing silica fine particles, external addition conditions, and so forth, the toner is sufficiently easily disaggregated upon the application of pressure.

As described above, the control of the disaggregation properties of the toner inhibits the stick-slip of the cleaning member, thereby inhibiting the occurrence of the cleaning failure. Furthermore, the micro-slip of the charging member according to the present invention is inhibited, and the driven rotation is stabilized, thus inhibiting the smudge on the charging member.

Figure 11:
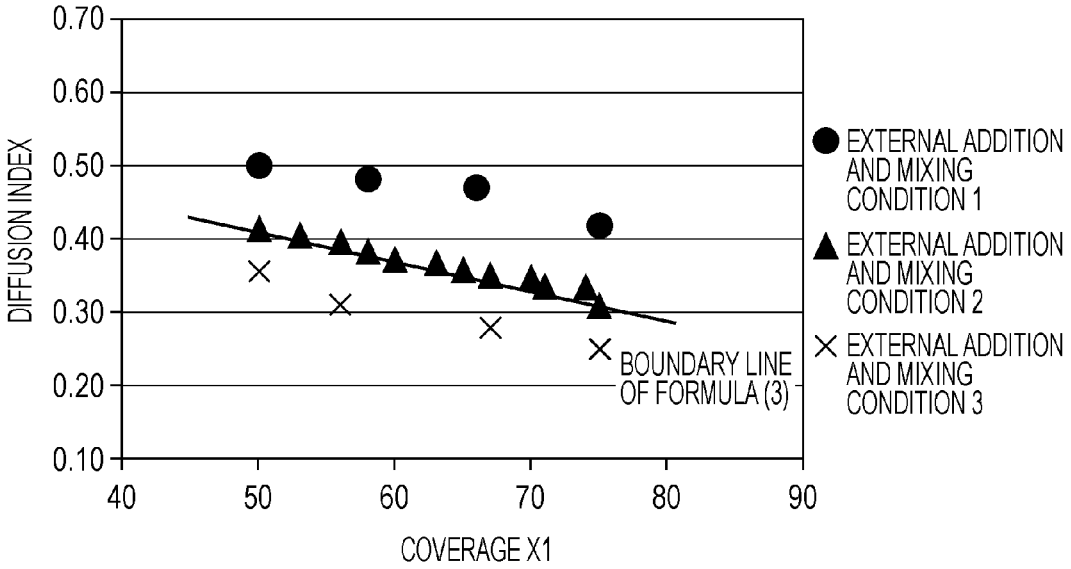
FIG. 11 is a graph illustrating the boundary line of the diffusion index of a toner according to the present invention.

FIG. 11 is a graph plotting the relationship between the coverage ratio X1 and the diffusion index when toners having freely-selected different coverage ratios X1 were produced under three different external addition and mixing conditions by the use of different amounts of silica fine particles added. It was found that among these toners plotted in this graph, the toner plotted in the region that satisfies the formula 2 had sufficiently improved disaggregation properties upon the application of pressure.

Regarding the reason why the diffusion index is dependent on the coverage ratio X1 , the inventors speculate the following. To improve the disaggregation properties of the toner upon the application of pressure, while a smaller amount of the silica fine particles present in the form of secondary particles is better, it is subjected to no small effect of the coverage ratio X1 . The disaggregation properties of the toner are gradually improved as the coverage ratio X1 increases. Thus, the allowable amount of the silica fine particles present in the form of secondary particles is increased. In this way, the boundary line of the diffusion index is considered to be a function of the coverage ratio X1 as the variable. That is, it was experimentally determined that a correlation exists between the coverage ratio X1 and the diffusion index and that it is important to control the diffusion index in response to the coverage ratio X1 .

In the case where the diffusion index is in the range indicated by the formula 3 described below, a large amount of the silica fine particles is present in the form of secondary particles. This causes the occurrence of the cleaning failure and the smudge on the charging member because of insufficient disaggregation properties of the toner:

$$\text{diffusion index} < -0.0042 \times X1 + 0.62 \quad \text{(formula 3)}$$

As described above, in order to inhibit the occurrence of the cleaning failure and the smudge on the charging member, the inventors believe that the toner is required to satisfy items (1) to (4) described above. It is speculated that the control of both "the surface properties of the silica fine particles" and "the state of the externally added silica fine particles" creates a synergistic effect, so that the toner according to the present invention provides the properties described in items (1) to (4) to first overcome the foregoing problems.

The toner according to the present invention contains a colorant.

Examples of the colorant preferably used in the present invention are described below.

Examples of organic pigments and organic dyes that may be used as cyan colorants include copper phthalocyanine compounds and derivatives thereof, anthraquinone compounds, and basic dye lake compounds.

Examples of organic pigments and organic dyes that may be used as magenta colorants include condensed azo compounds, diketopyrrolopyrrole compounds, anthraquinone and quinacridone compounds, basic dye lake compounds, naphthol compounds, benzimidazolone compounds, thioindigo compounds, and perylene compounds.

Examples of organic pigments and organic dyes that may be used as yellow colorants include condensed azo compounds, isoindolinone compounds, anthraquinone compounds, azo metal complexes, methine compounds, and allylamide compounds.

Examples of black colorants include carbon black; and black colorants prepared by mixing the foregoing yellow colorants, the foregoing magenta colorants, and the foregoing cyan colorants.

In the case where a colorant is used, the colorant is preferably added in an amount of 1 part by mass or more and 20 parts by mass or less based on 100 parts by mass of a polymerizable monomer or the binder resin T.

The toner according to the present invention may contain a magnetic material. In the present invention, the magnetic material may also serve as a colorant.

The magnetic material used in the present invention is mainly composed of, for example, triiron tetroxide or γ-iron oxide, and may contain an element, for example, phosphorus, cobalt, nickel, copper, magnesium, manganese, or aluminum. Examples of the shape of the magnetic material include polyhedral, octahedral, hexahedral, spherical, needle-like, and flaky shapes. Shapes having a low degree of anisotropy, such as polyhedral, octahedral, hexahedral, and spherical shapes, are preferred for the purpose of increasing the image density. The magnetic material content in the present invention is preferably 50 parts by mass or more and 150 parts by mass or less based on 100 parts by mass of the polymerizable monomer or the binder resin T.

The toner according to the present invention preferably contains a wax. The wax preferably contains a hydrocarbon wax. Examples of other waxes include amide waxes, higher fatty acids, long-chain alcohols, ketone waxes, ester waxes, and their derivatives, such as graft compounds and block compounds. Two or more types of waxes may be used in combination, as needed. Among these waxes, in the case where a hydrocarbon wax prepared by the Fischer-Tropsch process is employed, the hot offset resistance can be maintained at a satisfactory level with satisfactory developability maintained over an extended period of time. These hydrocarbon waxes each may contain an antioxidant to the extent that the antioxidant does not affect the chargeability of the toner.

The wax content is preferably 4.0 parts by mass or more and 30.0 parts by mass or less and more preferably 16.0 parts by mass or more and 28.0 parts by mass based on 100 parts by mass of the binder resin T.

In the toner according to the present invention, the toner particles may contain a charge control agent, as needed. The incorporation of the charge control agent results in stable charging characteristics, thus enabling the control of the optimal amount of triboelectric charge in response to a development system.

As the charge control agent, a known charge control agent may be used. In particular, a charge control agent having a rapid charging speed and being capable of stably maintaining a certain amount of charge is preferred. In the case where the toner particles are produced by a direct polymerization process, a charge control agent having low polymerization inhibiting properties and containing substantially no substance capable of dissolving in an aqueous medium is particularly preferred.

These charge control agents may be contained in the toner according to the present invention separately or in combination of two or more.

The amount of the charge control agent added is preferably 0.3 parts by mass or more and 10.0 parts by mass or less and more preferably 0.5 parts by mass or more and 8.0 parts by mass or less based on parts by mass of the polymerizable monomer or the binder resin T.

The toner according to the present invention includes toner particles and inorganic fine particles. In the present invention, the inorganic fine particles are silica fine particles.

The silica fine particles used in the present invention are produced by subjecting 100 parts by mass of a silica raw material to hydrophobic treatment with 15.0 parts by mass or more and 40.0 parts by mass or less of a silicone oil. Regarding the degree of the hydrophobic treatment, the degree of hydrophobicity measured by a methanol titration test is preferably 70% or more and more preferably 80% or more from the viewpoint of inhibiting a reduction in chargeability in a high-temperature and high-humidity environment.

Examples of the silicone oil include dimethylsilicone oil, methylphenylsilicone oil, α-methylstyrene-modified silicone oil, chlorophenyl silicone oil, and fluorine-modified silicone oil.

In the present invention, the silicone oil used for the treatment of the silica fine particles preferably has a kinematic viscosity of 30 cSt or more and 500 cSt or less at 25° C. When the kinematic viscosity is in the range described above, it is easy to control the uniformity upon subjecting the silica raw material to the hydrophobic treatment with the silicone oil. Furthermore, the kinematic viscosity of the silicone oil correlates closely with the length of the molecular chain of the silicone oil. When the kinematic viscosity is in the range described above, the degree of aggregation of the silica fine particles is easily controlled in a suitable range, which is preferred. The silicone oil more preferably has a kinematic viscosity of 40 cSt or more and 300 cSt or less at 25° C. Examples of an apparatus for measuring the kinematic viscosity of the silicone oil include capillary kinematic viscometers (manufactured by Kaburagi Scientific Instruments Ltd.) and an automatic small-sample-volume kinematic viscometer (manufactured by Viscotech Co., Ltd.).

The silica fine particles used in the present invention is preferably produced by treating the silica raw material with the silicone oil and subsequently with at least one of an alkoxysilane and a silazane. In this case, a surface portion of the silica raw material that has not been subjected to hydrophobic treatment with the silicone oil can be subjected to hydrophobic treatment. It is thus possible to stably produce the silica fine particles having a high degree of hydrophobicity. Furthermore, the disaggregation properties of the toner are significantly improved, which is preferred. While details of the reason why the disaggregation properties is improved are not yet understood, the inventors believe the following: Among ends of silicone oil molecules on the surfaces of the silica fine particles, only one end of each of the silicone oil molecules has the degree of flexibility and affects the aggregability between the silica fine particles. In the case where two-stage treatment as described above is performed, few ends of the silicone oil molecules are present on the outermost surfaces of the silica fine particles, thus enabling the aggregability of the silica fine particles to decrease. The results in a significant reduction in the aggregability between the toner particles when external addition is performed, thereby improving the disaggregation properties of the toner.

In the present invention, examples of the silica raw material that may be used include what is called dry silica and fumed silica formed by the vapor phase oxidation of a silicon halide; and what is called wet silica produced from, for example, water glass.

The silica fine particles used in the present invention may be subjected to disaggregation treatment during or after the foregoing treatment step. Furthermore, in the case where the two-stage treatment is performed, the disaggregation treatment may be performed between the stages.

The surface treatment of the silica raw material with the silicone oil and the surface treatment of the silica raw material with the alkoxysilane and the silazane may be performed by a dry process or a wet process.

A specific procedure for the surface treatment of the silica raw material with the silicone oil is as follows: For example, the silica fine particles are added to a solvent containing the silicone oil dissolved therein (the mixture is preferably adjusted so as to have a pH of 4 with, for example, an organic acid) to perform the reaction. Then the solvent is removed. Thereafter, the disaggregation treatment may be performed.

A specific procedure for the surface treatment with at least one of the alkoxysilane and the silazane is described below.

Disaggregated silicone oil-treated silica fine particles are added to a solvent containing at least one of the alkoxysilane and the silazane dissolved therein to perform the reaction. Then the solvent is removed. Thereafter, disaggregation treatment is performed.

Alternatively, the following method may be employed. For example, in the case of the surface treatment with the silicone oil, the silica fine particles are charged into a reaction vessel. An aqueous alcohol solution is added thereto in a nitrogen atmosphere under stirring. The silicone oil is introduced into the reaction vessel to perform the surface treatment. The mixture is heated under stirring to remove the solvent. Then disaggregation treatment is performed. In the case of the surface treatment with at least one of the alkoxysilane and the silazane, at least one of the alkoxysilane and the silazane is introduced to perform the surface treatment in a nitrogen atmosphere under stirring. The mixture is heated under stirring to remove a solvent. Then cooling is performed.

Preferred examples of the alkoxysilane include methyltrimethoxysilane, dimethyldimethoxysilane, phenyltrimethoxysilane, methyltriethoxysilane, dimethyldiethoxysilane, and phenyltriethoxysilane. A preferred example of the silazane is hexamethyldisilazane.

Regarding the amount of at least one of the alkoxysilane and the silazane used for the treatment, the total amount of at least one of the alkoxysilane and the silazane is 0.1 parts by mass or more and 20.0 parts by mass or less based on 100 parts by mass of the silica raw material.

To increase the fixation ratio of the silicone oil based on the amount of carbon in the silica fine particles, the silicone oil needs to be fixed to the surface of the silica raw material in the course of the production of the silica fine particles. To that end, a method in which heat treatment is performed for the reaction of the silicone oil in the course of the production of the silica fine particles is preferably exemplified. The heat-treatment temperature is preferably 100° C. or higher. A higher heat-treatment temperature results in an increase in fixation ratio. The heat-treatment step is preferably performed immediately after the treatment with the silicone oil. If the disaggregation treatment is performed, the heat-treatment step may be performed after the disaggregation treatment step.

The silica fine particles used in the present invention preferably have an apparent density of 15 g/L or more and 50 g/L or less. The fact that the apparent density of the silica fine particles is in the range described above indicates that the silica fine particles are not so closely packed, are present with a large amount of air contained between the fine particles, and have a very low apparent density. Thus, the toner particles are not so closely packed, significantly reducing the rate of degradation. The silica fine particles more preferably have an apparent density of 18 g/L or more and 45 g/L or less.

Examples of a method for controlling the apparent density of the silica fine particles to the range described above include adjustments of the particle diameter of the silica raw material used for the silica fine particles, whether the foregoing disaggregation treatment is performed or not and the intensity thereof, and the amount of the silicone oil used for the treatment. A smaller particle diameter of the silica raw material results in a higher BET specific surface area of the resulting silica fine particles; hence, a larger amount of air can be contained to reduce the apparent density. Relatively large secondary particles contained in the silica fine particles can be disaggregated into relatively small secondary particles by the disaggregation treatment, thus reducing the apparent density.

To impart satisfactory flowability to the toner, the silica raw material used in the present invention preferably has a specific surface area of 130 $m^2/g$ or more and 330 $m^2/g$ or less, the specific surface area being measured by the BET method using nitrogen adsorption (BET specific surface area). In this range, the flowability and the chargeability imparted to the toner are provided throughout endurance running. The silica raw material more preferably has a BET specific surface area of 200 $m^2/g$ or more and 320 $m^2/g$ or less.

Measurement of the specific surface area measured by the BET method using nitrogen adsorption (BET specific surface area) is performed according to JIS 28830 (2001). A surface area and porosimetry analyzer (TriStar 3000, manufactured by Shimadzu Corporation), which employs constant volume gas adsorption as the method of measurement, is used as the measurement apparatus.

The primary particles of the silica raw material preferably have a number-average particle diameter of 3 nm or more and 50 nm or less and more preferably 5 nm or more and 40 nm or less.

The toner according to the present invention preferably has a weight-average particle diameter (D4) of 5.0 μm or more and 10.0 μm or less and more preferably 5.5 μm or more and 9.5 μm or less in view of a balance between the developability and fixability.

In the present invention, the toner particles preferably have an average circularity of 0.960 or more and more preferably 0.970 or more. When the toner particles have an average circularity of 0.960 or more, each of the toner particles has a spherical shape or an approximately spherical shape. Thus, the toner has excellent flowability and easily acquires uniform triboelectric chargeability, so that high developability is easily maintained even in the latter half of endurance running, which is preferred. In addition, the toner particles having a high average circularity is preferred because they easily permit the ranges of the coverage ratio X1 and the diffusion index to be controlled in the range of the present invention in the external addition treatment of the inorganic fine particles described below. Furthermore, also from the viewpoint of the disaggregation properties of the toner upon the application of pressure, the interlocking effect due to the surface shape of the toner particles is less likely to be provided, thereby further improving the disaggregation properties, which is preferred.

While a method for producing the toner according to the present invention is exemplified below, the method is not limited thereto.

In the toner according to the present invention, the number of parts of the silica fine particles treated with the silicone oil, the fixation ratio of the silicone oil based on the amount of carbon, the coverage ratio X1 , and the diffusion index may be adjusted. Preferably, in a production method including the step of adjusting the average circularity, other production steps are not particularly limited, and the toner may be produced by a known method.

In the case of production by a pulverization method, for example, the binder resin T, the colorant, and, optionally, another additive, such as a release agent, are sufficiently mixed together with a mixer, for example, a Henschel mixer or a ball mill. Then melt-kneading is performed with a heating kneader, for example, a heating roller, a kneader, or an extruder, to disperse or melt the toner material. The mixture is solidified by cooling. After pulverization, classification and, optionally, surface treatment are performed to provide toner particles. The order of the classification and the surface treatment may be changed. In the classification step, a multi-grade classifier is preferably used in view of production efficiency.

The pulverization may be performed by a method using a known pulverizer, for example, a mechanical impact-type or jet-type machine. To produce the toner having preferable circularity, it is preferable to further apply heat to effect pulverization or to perform treatment of applying auxiliary mechanical impact. Also usable are a hot-water bath method in which toner particles finely pulverized (and optionally classified) are dispersed in hot water, and a method in which the toner particles are passed through hot-air stream.

Examples of a means for applying a mechanical impact force include a method in which a mechanical impact type pulverizer, for example, Kryptron system, manufactured by Kawasaki Heavy Industries, Ltd., or Turbo mill, manufactured by Turbo Kogyo Co., Ltd., is used; and a method in which a mechanical impact force is applied to a toner by a compressive force or friction force with an apparatus, for example, a mechanofusion system manufactured by Hosokawa Micron Corporation or a hybridization system manufactured by Nara Machinery Co., Ltd.

The toner particles used in the present invention are preferably produced by a method in which the toner is produced in an aqueous medium. Examples of the method include a dispersion polymerization method, an association aggregation method, a dissolution suspension method, and a suspension polymerization method. The toner particles are more preferably produced by the suspension polymerization method.

In the suspension polymerization method, a polymerizable monomer, a colorant, and optionally additional additives, such as a polymerization initiator, a crosslinking agent, and a charge control agent are uniformly dissolved or dispersed to prepare a polymerizable monomer composition. Then the polymerizable monomer composition is dispersed in a continuous phase (for example, an aqueous phase) containing a dispersion stabilizer with an appropriate stirrer. The polymerizable monomer in the polymerizable monomer composition is polymerized to prepare toner particles having a desired particle diameter. The toner particles prepared by the suspension polymerization method (hereinafter, also referred to as "polymerized toner particles) are preferred because the individual toner particles have a substantially spherical shape, the toner particles satisfy a predetermined average circularity, and the distribution of the amount of charge is relatively uniform.

In the production of polymerized toner particles according to the present invention, a known monomer may be used as the polymerizable monomer in the polymerizable monomer composition. Preferably, styrene or a styrene derivative is used alone or is combined with another polymerizable monomer to form a mixture before use in view of the developing characteristics and the durability of the toner.

In the present invention, the polymerization initiator used in the suspension polymerization method preferably has a half-life of 0.5 hours or more and 30.0 hours or less during the polymerization reaction. The amount of the polymerization initiator added is preferably 0.5 parts by mass or more and 20.0 parts by mass or less based on 100 parts by mass of the polymerizable monomer.

Specific examples of the polymerization initiator include azo or diazo-based polymerization initiators; and peroxide-based polymerization initiators.

In the suspension polymerization method, a crosslinking agent may be added at the time of the polymerization reaction. The amount added is preferably 0.1 parts by mass or more and 10.0 parts by mass or less based on 100 parts by mass of the polymerizable monomer. Here, a compound having two or more polymerizable double bonds is mainly used as the crosslinking agent. Examples thereof include aromatic divinyl compounds, carboxylates each having two double bonds, divinyl compounds, and compounds each having three or more vinyl groups. These compounds may be used separately or in combination as a mixture of two or more.

While the production of the toner particles by the suspension polymerization method will be specifically described below, the present invention is not limited thereto. The photosensitive member, the colorant, and so forth are appropriately added and uniformly dissolved or dispersed with a disperser, for example, a homogenizer, a ball mill, or an ultrasonic disperser, to prepare a polymerizable monomer composition. The polymerizable monomer composition is suspended in a dispersion stabilizer-containing aqueous medium. At this time, when a disperser, for example, a high-speed agitator or an ultrasonic disperser, is used to achieve a desired toner particle size in one operation, the resulting toner particles have a narrow particle diameter distribution. Regarding the timing of the addition of the polymerization initiator, the polymerization initiator may be added simultaneously with the addition of the additional additives to the photosensitive member or may be added immediately before the suspension of the composition in the aqueous medium. Alternatively, the polymerization initiator dissolved in the photosensitive member or a solvent may be added immediately after granulation and before the initiation of the polymerization reaction.

After the granulation, stirring may be performed with a common stirrer in such a manner that the particle state is maintained and that the floating and settling of the particles are prevented.

A known surfactant, an organic dispersant, or an inorganic dispersant may be used as the dispersion stabilizer. The inorganic dispersant is preferably used because the inorganic dispersant is not readily cause the formation of a harmful ultrafine powder, its steric hindrance provides dispersion stability, the stability is not readily reduced even if the reaction temperature is changed, cleaning is easy, and the inorganic dispersant is less likely to adversely affect the toner.

Examples of the inorganic dispersant include polyvalent metal salts of phosphoric acid, such as tricalcium phosphate, magnesium phosphate, aluminum phosphate, zinc phosphate, and hydroxyapatite; carbonates, such as calcium carbonate and magnesium carbonate; inorganic salts, such as calcium metasilicate, calcium sulfate, and barium sulfate; and inorganic compounds, such as calcium hydroxide, magnesium hydroxide, and aluminum hydroxide.

Each of the inorganic dispersants may be preferably used in an amount of 0.20 parts by mass or more and 20.00 parts by mass or less based on 100 parts by mass of the photosensitive member. These dispersion stabilizers may be used separately. Alternatively, a plurality of dispersion stabilizers may be used in combination. Furthermore, a combined use of 0.0001 parts by mass or more and 0.1000 parts by mass or less of a surfactant may be made based on 100 parts by mass of the photosensitive member.

In the polymerization reaction of the polymerizable monomer, the polymerization temperature is set to 40° C. or higher and commonly 50° C. or higher and 90° C. or lower.

After the completion of the polymerization of the photosensitive member, the resulting polymer particles are filtered, washed, and dried by known methods to give toner particles. The silica fine particles serving as inorganic fine particles are externally added to and mixed with the toner particles, so that the silica fine particles adhere to the surfaces of the toner particles, thereby providing the toner according to the present invention. A classification step may be performed in the production process (before the mixing of the inorganic fine particles) to remove a coarse powder and a fine powder in the toner particles.

In addition to the above silica fine particle, the toner according to the present invention may further contain particles with the primary particles having a number-average particle diameter (D1) of 80 nm or more and 3 μm or less. Examples of the particles include lubricants, such as a fluorocarbon resin powder, a zinc stearate powder, and a polyvinylidene fluoride powder; abrasives, such as a cerium oxide powder, a silicon carbide powder, and a strontium titanate powder; and spacer particles, such as silica. These particles may be used in small amounts to the extent that the advantageous effects of the present invention are not affected.

A known mixing treatment apparatus may be used as a mixing treatment apparatus for the external addition and mixing of the silica fine particles. An apparatus as illustrated in FIG. 13 is preferred from the viewpoint of easily control the coverage ratio X1 and the diffusion index.

Figure 13:
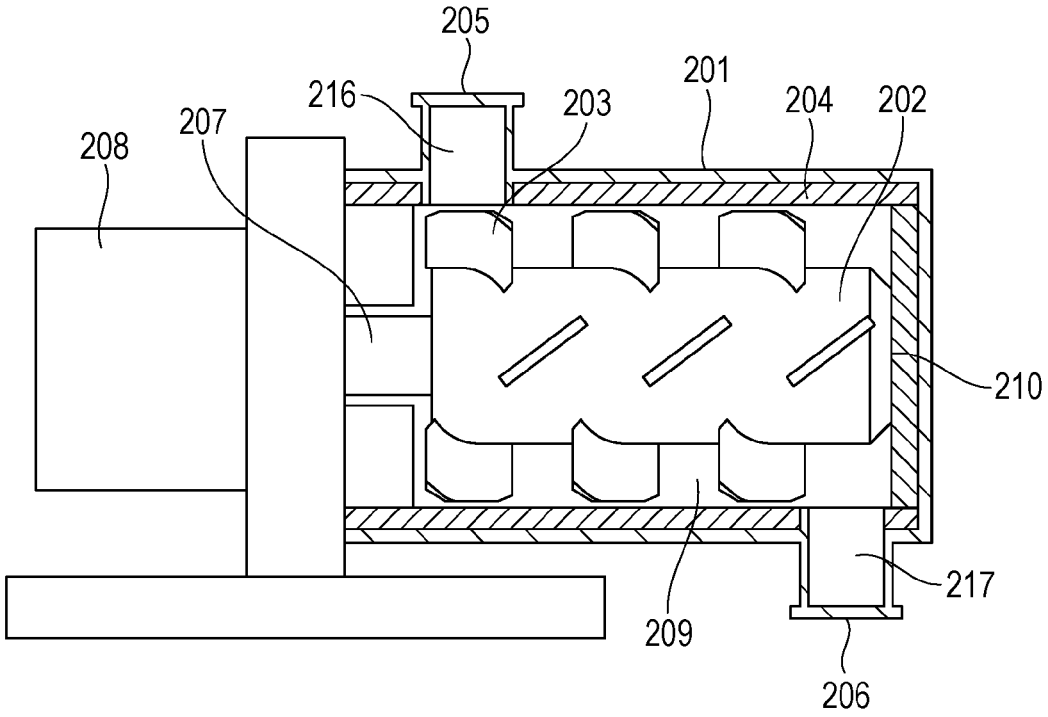
FIG. 13 is a schematic cross-sectional view of an embodiment of a mixing treatment apparatus that can be used for external addition and mixing of inorganic fine particles according to the present invention.

FIG. 13 is a schematic diagram of an example of a mixing treatment apparatus that may be used to perform the external addition and mixing of the silica fine particles used in the present invention. The mixing treatment apparatus is configured to allow the toner particles and the silica fine particles to be sheared in a narrow clearance portion. Thus, the silica fine particles adhere to the surfaces of the toner particles while the silica fine particles are being disaggregated from secondary particles to primary particles.

Furthermore, as described below, the toner particles and the silica fine particles are readily circulated in the axial direction of a rotary member and thus sufficiently uniformly mixed together before the progress of fixation; hence, the coverage ratio X1 and the diffusion index are easily controlled in preferred ranges in the present invention.

Figure 14:
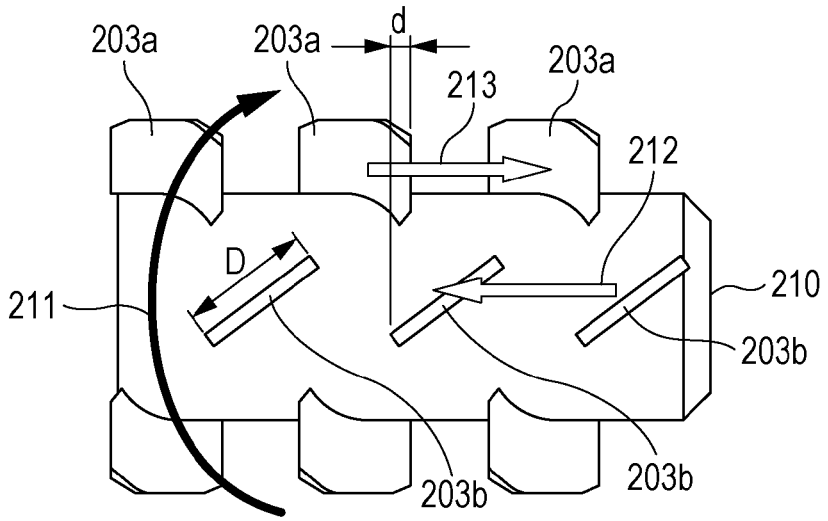
FIG. 14 is a schematic cross-sectional view illustrating an embodiment of the structure of a stirring member used for a mixing treatment apparatus according to the present invention.

FIG. 14 is a schematic drawing of an example of the structure of a stirring member used for the mixing treatment apparatus.

The external addition and mixing step of the silica fine particles will be described below with reference to FIGS. 13 and 14.

The mixing treatment apparatus configured to perform the external addition and mixing includes a rotary member 202 with a surface on which at least a plurality of stirring members 203 are disposed, a drive member 208 configured to rotationally drive the rotary member, and a main casing 201 disposed with a distance kept between the stirring members 203 and the main casing.

It is important that the clearance between the inner peripheral portion of the main casing 201 and the stirring members 203 is kept constant and very small in order to uniformly apply shear to the toner particles and allow the silica fine particles to adhere easily to the surfaces of the toner particles with the silica fine particles disaggregated from secondary particles to primary particles.

In the apparatus, the diameter of the inner peripheral portion of the main casing 201 is two or less times the diameter of the outer peripheral portion of the rotary member 202. FIG. 13 illustrates an example in which the diameter of the inner peripheral portion of the main casing 201 is 1.7 times the diameter of the outer peripheral portion of the rotary member 202 (i.e., the diameter of the cylindrical body, excluding the stirring members 203 from the rotary member 202). In the case where the diameter of the inner peripheral portion of the main casing 201 is two or less times the diameter of the outer peripheral portion of the rotary member 202, the processing space where a force acts on the toner particles is appropriately limited, thus allowing a sufficient impact force to be applied to the silica fine particles present in the form of secondary particles.

It is important to adjust the clearance in response to the size of the main casing. Setting the clearance to about 1% or more and about 5% or less of the diameter of the inner peripheral portion of the main casing 201 is important from the viewpoint of applying sufficient shear to the silica fine particles. Specifically, when the diameter of the inner peripheral portion of the main casing 201 is about 130 mm, the clearance may be about 2 mm or more and about 5 mm or less. When the diameter of the inner peripheral portion of the main casing 201 is about 800 mm, the clearance may be about 10 mm or more and about 30 mm or less.

In the external addition and mixing step of the silica fine particles in the present invention, the mixing treatment apparatus is used. The drive member 208 rotates the rotary member 202 to stir and mix the toner particles and the silica fine particles charged into the mixing treatment apparatus. In this way, the silica fine particles are subjected to the external addition and mixing treatment on the surfaces of the toner particles. As illustrated in FIG. 14, at least some of the plural stirring members 203 serve as forward stirring members 203*a* configured to feed the toner particles and the silica fine particles in one of the axial directions of the rotating member with the rotation of the rotary member 202. Furthermore, at least some of the plural stirring members 203 serve as backward stirring members 203*b* configured to feed the toner particles and the silica fine particles in the other axial direction with the rotation of the rotary member 202.

Here, when a raw material inlet port 205 and a product discharge port 206 are arranged at both ends of the main casing 201 as illustrated in FIG. 13, a direction from the raw material inlet port 205 toward the product discharge port 206 (a direction to the right in FIG. 13) is referred to as a "forward direction".

That is, as illustrated in FIG. 14, surfaces of each of the forward stirring members 203*a* are inclined so as to feed the toner particles in the forward direction (213). Surfaces of the backward stirring members 203*b* are inclined so as to feed the toner particles and the silica fine particles in a backward direction (212). Thus, the external addition of the silica fine particles to the surfaces of the toner particles and mixing are performed while repeatedly performing the feed in the "forward direction" (213) and the feed in the "backward direction" (212).

The stirring members 203*a* and 203*b* are provided in the form of sets of a plurality of the members arranged at intervals in the circumferential direction of the rotary member 202. In the example illustrated in FIG. 14, the stirring members 203*a* and 203*b* are provided in the form of sets of two members located at mutual intervals of 180 degrees on the rotary member 202. A larger number of members may be similarly provided in the form of sets, such as three members at intervals of 120 degrees or four blades at intervals of 90 degrees.

In the example illustrated in FIG. 14, a total of 12 stirring members 203*a* and 203*b* are provided at regular intervals.

In FIG. 14, D represents the width of the stirring member, and d represents a distance of an overlapping portion of the stirring members. From the viewpoint of efficiently feeding the toner particles and the silica fine particles in the forward and backward directions, the width D is preferably about 20% or more and about 30% of the length of the rotary member 202 in FIG. 14. FIG. 14 illustrates an example in which the value is 23%. Furthermore, when an extension line is drawn from an end of each of the stirring members 203*a* in the vertical direction, the stirring members 203*a* and 203*b* preferably have a certain degree of d of a portion where each of the stirring members 203*a* overlaps a corresponding one of the stirring members. This enables shear to be efficiently applied to the silica fine particles present in the form of secondary particles. The ratio of d to D is preferably 10% or more and 30% or less in view of the application of shear.

In addition to the blade shape illustrated in FIG. 14, the blade shape may be a shape having a curved surface or a paddle structure in which a distal blade portion is connected to the rotary member 202 with a rod-shaped arm as long as the toner particles can be fed in the forward direction and back direction and the clearance is maintained.

The present invention will be described in more detail below with reference to the schematic diagrams of the apparatus illustrated in FIGS. 13 and 14.

The apparatus illustrated in FIG. 13 includes a central shaft 207, the rotary member 202 with the surface on which at least the plural stirring members 203 are disposed, and the drive member 208 configured to rotationally drive the rotary member 202. The apparatus illustrated in FIG. 13 further includes the main casing 201 disposed with a distance kept between the stirring members 203 and the main casing and a jacket 204 which is located inside the main casing 201 and an end surface 210 of the rotary member and through which a heat medium can flow.

The apparatus illustrated in FIG. 13 includes the raw material inlet port 205 disposed on the upper portion of the main casing 201 in order to introduce the toner particles and the silica fine particles. The apparatus illustrated in FIG. 13 includes the product discharge port 206 disposed on the lower portion of the main casing 201 in order to discharge the toner that has been subjected to the external addition and mixing treatment from the main casing 201 to the outside. The apparatus illustrated in FIG. 13 includes an inner piece 216 for the raw material inlet port in the raw material inlet port 205, and an inner piece 217 for the product discharge port in the product discharge port 206.

In the present invention, the inner piece 216 for the raw material inlet port is removed from the raw material inlet port 205. The toner particles are charged into a processing space 209 from the raw material inlet port 205. The silica fine particles are charged into the processing space 209 from the raw material inlet port 205. The inner piece 216 for the raw material inlet port is inserted. The rotary member 202 is rotated by the drive member 208 (211 denotes the direction of rotation), thereby subjecting the charged materials to the external addition and mixing treatment while the charged materials are stirred and mixed together using the plural stirring members 203 provided on the surface of the rotary member 202.

Regarding the sequence of charging, the silica fine particles may first be charged from the raw material inlet port 205, and then the toner particles may be charged from the raw material inlet port 205. Alternatively, the toner particles and the silica fine particles may be mixed together in advance with a mixer, such as a Henschel mixer. Then the mixture may be charged from the raw material inlet port 205 of the apparatus illustrated in FIG. 13.

More specifically, in terms of the external addition and mixing treatment conditions, the power of the drive member 208 is preferably controlled to 0.2 W/g or more and 2.0 W/g or less in order to achieve the coverage ratio X1 and the diffusion index specified in the present invention. More preferably, the power of the drive member 208 is controlled to 0.6 W/g or more and 1.6 W/g or less.

At a power of less than 0.2 W/g, a high coverage ratio X1 is less likely to be obtained, and an excessively low diffusion index tends to be obtained. As a power of more than 2.0 W/g, although a high diffusion index is obtained, the silica fine particles have a tendency to be excessively embedded.

The processing time is, but not particularly limited to, preferably 3 minutes or more and 10 minutes or less. At a processing time shorter than 3 minutes, the coverage ratio X1 and the diffusion index tend to be low.

The number of revolutions of the stirring members during the external addition and mixing is not particularly limited. In an apparatus having a volume of the processing space 209 of $2.0\times10^{-3}$ $m^3$, the number of revolutions of the stirring members is preferably 800 rpm or more and 3000 rpm or less when the stirring members 203 have the shape illustrated in FIG. 13. When the number of revolutions is 800 rpm or more and 3000 rpm or less, it is easy to obtain the coverage ratio X1 and the diffusion index specified in the present invention.

In the present invention, an especially preferred treatment method is to provide a premixing step before the external addition and mixing treatment operation. In the premixing step, the silica fine particles are highly uniformly dispersed on the surfaces of the toner particles. This facilitates the achievement of a high coverage ratio X1 and a high diffusion index.

More specifically, in terms of the premixing treatment conditions, the power of the drive member 208 is preferably 0.06 W/g or more and 0.20 W/g or less, and the treatment time is preferably 0.5 minutes or more and 1.5 minutes or less. Regarding the premixing treatment conditions, when the load power is less than 0.06 W/g or the treatment time is shorter than 0.5 minutes, it is difficult to perform sufficiently uniform mixing as the premixing. Regarding the premixing treatment conditions, when the load power is more than 0.20 W/g or treatment time is longer than 1.5 minutes, the silica fine particles are fixed to the surfaces of the toner particles before sufficiently uniform mixing is accomplished, in some cases.

With respect to the number of revolutions of the stirring members in the premixing treatment, in the apparatus having a volume of the processing space 209 of $2.0\times10^{-3}$ $m^3$, when the stirring members 203 have the shape illustrated in FIG. 14, the number of revolutions of the stirring members is preferably 50 rpm or more and 500 rpm or less. When the number of revolutions is 50 rpm or more and 500 rpm or less, it is easy to obtain the coverage ratio X1 and the diffusion index specified in the present invention.

After the completion of the external addition and mixing treatment, the inner piece 217 for the product discharge port is removed from the product discharge port 206. The rotary member 202 is rotated by the drive member 208 to discharge the resulting toner from the product discharge port 206. Coarse particles and so forth are separated from the resulting toner with a sieve, such as a circular oscillating sieve, as needed. Thereby, the toner is provided.

In the present invention, methods for measuring various properties will be described below.

Method for Quantitatively Determining Silica Fine Particles (1) Determination of Silica Fine Particle Content of Toner (Standard Addition Method)

Into an aluminum ring with a diameter of 30 mm, 3 g of the toner is charged. A pellet is produced at a pressure of 10 tons. The intensity of silicon (Si) is measured (Si intensity-1) by wavelength-dispersive fluorescent X-ray analysis (XRF). The measurement conditions may be conditions that have been optimized in an XRF apparatus used, a series of intensity measurements shall all be performed under the same conditions. The silica fine particles having primary particles with a number-average particle diameter of 12 nm are added to the toner in an amount of 1.0% by mass.

The mixture is mixed using a coffee mill.

After the mixing, pelletization is performed in the same way as described above. The intensity of Si is determined as described above (Si intensity-2). The same operation is performed to determine the intensity of Si (Si intensity-3 and Si intensity-4) for a sample prepared by adding 2.0% by mass of the silica fine particles to the toner and a sample prepared by adding 3.0% by mass of the silica fine particles to the toner. The silica content (% by mass) of the toner is calculated by the standard addition method using Si intensity-1 to Si intensity-4.

(2) Separation of Silica Fine Particles from Toner

When the toner contains a magnetic material, the determination of the silica fine particles is performed through steps described below.

Five grams of the toner is weighed with a precision scale and charged into a 200-mL plastic cup equipped with a lid. Then 100 mL of methanol is added thereto. The mixture is dispersed for 5 minutes with an ultrasonic disperser. The toner is attracted with a neodymium magnet. The supernatant is discarded. The operations of dispersing in methanol and discarding supernatant are repeated three times. Then, 100 mL of 10% NaOH and several drops of "Contaminon N" (a 10% by mass aqueous solution of a neutral (pH 7) cleanser for cleaning precision analyzers, the solution containing a nonionic surfactant, an anionic surfactant, and an organic builder, manufactured by Wako Pure Chemical Industries, Ltd.) are added and lightly mixed. The mixture is allowed to stand for 24 hours. Thereafter, separation is performed again with the neodymium magnet. Here, the resulting particles are repeatedly rinsed with distilled water in such a manner that NaOH is not left. The recovered particles are sufficiently dried with a vacuum drier to provide particles A. The Added Silica Fine Particles are Dissolved and Removed by the Foregoing Operations.

(3) Measurement of Si Intensity in Particle A

Into an aluminum ring having a diameter of 30 mm, 3 g of particles A are charged. A pellet is formed at a pressure of 10 tons. The Si intensity (Si intensity-5) is determined by wavelength-dispersive X-ray analysis (XRF). The silica content (% by mass) of particles A is calculated using Si intensity-5 and Si intensity-1 to Si intensity-4 used to determine the silica content of the toner.

(4) Separation of Magnetic Material from Toner

First, 100 mL of tetrahydrofuran is added to 5 g of particles A. After sufficient mixing, the mixture is subjected to ultrasonic dispersion for 10 minutes. The magnetic material is attracted with a magnet. The supernatant is discarded. The operations are repeated 5 times to provide particles B. Organic components, such as a resin, other than the magnetic material are substantially removed by the operations. However, there is a probability that a component, which is insoluble in tetrahydrofuran, in the resin is left. Thus, particles B produced by the foregoing operations are preferably heated to 800° C. to burn the residual organic component. Particles C produced by the heating may be regarded as the magnetic material in the toner.

The mass of particles C is measured and may be regarded as the magnetic material content W (% by mass) in the magnetic toner. To correct for the amount of the magnetic material increased by oxidation, the mass of particles C is multiplied by 0.9666 ($Fe_2O_3 \rightarrow Fe_3O_4$). The amount of externally added silica fine particles is calculated by substitution of the respective quantitative values into the following formula:

Amount of externally added silica fine particles(% by mass)=silica content(% by mass) of toner−silica content (% by mass) of particles *A*

Method for Measuring Coverage Ratio X1

The coverage ratio X1 with the silica fine particles on the surface of the toner is calculated as described below.

The toner surface is subjected to elemental analysis with a measurement apparatus under the following conditions.

Measurement apparatus: Quantum 2000 (trade name, manufactured by Ulvac-Phi, Inc.)

X-ray source: Monochrome Al Kα

X-ray Setting: 100 μm diameter (25 W (15 KV))

Photoelectron take-off angle: 45°

Neutralization conditions: combination use of neutralization gun and ion gun

Analysis region: 300×200 μm

Pass energy: 58.70 eV

Step size: 1.25 eV

Analysis software: Maltipak (from PHI)

Here, C 1c (B.E. 280 to 295 eV), O 1s (B.E. 525 to 540 eV), and Si 2p (B.E. 95 to 113 eV) peaks were used to calculate the quantitative value for Si atoms. The resulting quantitative value of the Si element is defined as Y1.

Next, the silica fine particles are measured. As a method for obtaining the silica fine particles from the toner, the method described in "Separation of silica fine particles from toner" is employed. Atomic analysis of the silica fine particles obtained here is performed in the same way as in the foregoing atomic analysis at the toner surface.

The resulting quantitative value for the Si element obtained here is defined as "Y2".

In the present invention, the coverage ratio X1 of the toner surface with the silica fine particles is defined as follows:

coverage ratio $X1$(area %)=$Y1/Y2\times100$

To improve the accuracy of this measurement, Y1 and Y2 are preferably measured twice or more.

Method for Measuring Weight-Average Particle Diameter (D4) of Toner

The weight-average particle diameter (D4) of the toner is calculated as described below (the toner particles are also calculated in the same way). The measurement apparatus is a precision particle distribution analyzer based on a pore electrical resistance method and equipped with a 100 μm aperture tube (COULTER COUNTER Multisizer 3, registered trademark, manufactured by Beckman Coulter, Inc). Dedicated software (Beckman Coulter Multisizer 3, Version 3.51 (available from Beckman Coulter, Inc.)) included in the analyzer is used to set the measurement conditions and analyze the measurement data. Measurement is performed with the following number of effective measurement channels: 25,000.

An aqueous electrolyte solution usable for the measurement is prepared by dissolving special-grade sodium chloride in ion-exchanged water in a concentration of about 1% by mass. For example, "ISOTON II" (from Beckman Coulter, Inc.) may be used.

The dedicated software is configured as described below before measurement and analysis.

In the "Changing Standard Operating Mode (SOM)" screen of the dedicated software, the Total Count of the Control Mode is set to 50,000 particles. The Number of Runs is set to 1. The Kd value is set to a value obtained using "Standard particle 10.0 μm" (available from Beckman Coulter, Inc). Pressing the "Threshold/Noise Level Measuring Button" automatically sets the threshold and noise levels. The Current is set to 1600 μA. The Gain is set to 2. The Electrolyte is set to ISOTON II. A check mark is placed in "Flush aperture tube following measurement".

In the "setting conversion from pulses to particle diameter" screen of the dedicated software, the bin interval is set to logarithmic particle diameter. The particle diameter bin is set to 256 particle diameter bins. The particle diameter range is set in the range of 2 μm to 60 μm.

The specific measurement procedure is as follows.

(1) Into a 250-mL glass round-bottom beaker dedicated for Multisizer 3, 200 mL of the aqueous electrolyte solution is charged. The beaker is set to a sample stand. Stirring is performed counterclockwise with a stirrer rod at a speed of 24 rotations per second. The "Aperture Flush" function in the dedicated software is used to remove contaminants and air bubbles from the aperture tube.

(2) Into a 100-mL glass flat-bottom beaker, the 30 mL of the aqueous electrolyte solution is charged. To the beaker, 0.3 mL of a dilute solution is added as a dispersant, the dilute solution being prepared by diluting "Contaminon N" (a 10% by mass aqueous solution of a neutral (pH 7) cleanser for cleaning precision analyzers, the solution containing a nonionic surfactant, an anionic surfactant, and an organic builder, available from Wako Pure Chemical Industries, Ltd.) 3 times by mass with ion-exchanged water.

(3) An ultrasonic dispersion system "Tetora 150" (available from Nikkaki Bios Co., Ltd.) is prepared, the system having an electrical output of 120 W and being equipped with two oscillators each having an oscillation frequency of 50 kHz and are configured at a phase offset of 180 degrees. Then 3.3 L of ion-exchanged water is charged into a water tank of the system, and 2 mL of Contaminon N is added to the water tank.

(4) The beaker prepared in item (2) is set in a beaker-securing hole of the ultrasonic dispersion system, and the system is operated. The beaker height position is adjusted so as to maximize the resonance state of the liquid surface of the aqueous electrolyte solution in the beaker.

(5) To the aqueous electrolyte solution, 10 mg of the toner is gradually added, while the aqueous electrolyte solution in the beaker in item (4) is irradiated with ultrasound, so that the toner is dispersed in the solution. The ultrasonic dispersion treatment is continued for another 60 seconds. The ultrasonic dispersion is appropriately adjusted in such a manner that the temperature in the water tank is 10° C. or higher and 40° C. or lower.

(6) The aqueous electrolyte solution containing the toner dispersed therein described in item (5) is added dropwise with a pipette to the round-bottom beaker set in the sample stand described in item (1). Adjustment is performed in such a manner that the measurement concentration is 5%. The measurement is continued until the number of measured particles reaches 50,000.

(7) The measurement data is analyzed using the dedicated software included in the system to calculate the weight-average particle diameter (D4). When "Graph/Vol %" is selected in the dedicated software, the "average size" in the "Analysis/Volume Statistics (arithmetic mean)" screen indicates the weight-average particle diameter (D4). Method of measuring number-average particle diameter of primary particles of silica fine particles The number-average particle diameter of primary particles of the silica fine particles is calculated from an image of silica fine particles on a toner surface taken with a Hitachi S-4800 ultrahigh resolution field-emission scanning electron microscope (available form Hitachi High-Technologies Corporation). Image-capturing conditions with S-4800 are described below.

(1) Sample Preparation

A conductive paste is lightly applied to a sample stage (an aluminum stage measuring 15 mm×6 mm). The toner is sprayed thereon. An excess of the toner is removed from the sample stage by air blow. The paste is sufficiently dried. The sample stage is set to a sample holder. The stage height is adjusted to 36 mm with a sample height gauge.

(2) Setting of Observation Conditions with S-4800

The number-average particle diameter of primary particles of the silica fine particles is calculated using an image obtained by backscattered electron image observation with the S-4800. In the case of a backscattered electron image, less charge-up of the silica fine particle occurs, compared with a secondary electron image. Thus, the particle diameter of the silica fine particles is precisely measured.

Liquid nitrogen is poured into an anti-contamination trap attached to the housing of S-4800 to the point of overflowing. The microscope is allowed to stand for 30 minutes. The "PCSTEM" of S-4800 is booted up. Flushing (cleaning of an FE chip serving as an electron source) is performed. The acceleration voltage indicator portion of the control panel on the screen is clicked. The "Flushing" button is pressed. The Flushing Execution dialog box is opened. After verifying that flushing strength is 2, flushing is executed. It is verified that the emission current due to flushing is in the range of 20 to 40 μA. The sample holder is inserted into a sample chamber on the housing of S-4800. "Home" on the control panel is pressed to move the sample holder to an examination position.

The acceleration voltage indicator is clicked to open the HV selection dialog box. The acceleration voltage is set to [0.8 kV]. The emission current is set to [20 μA]. In the "Basic" tab on the operation panel, the signal selection is set to [SE]. [Up (U)] and [+BSE] are selected as the SE detectors. In the selection box to the right of [+BSE], [L.A. 100] is selected to set the microscope in the mode for observation in a backscattered electron image. In the [Basic] tab in the operation panel, the probe current in the Electron Optics Conditions block is set to [normal]. The focus mode is set to [UHR]. WD is set to [3.0 mm]. The [ON] button of the acceleration voltage indicator on the control panel is pressed to apply the acceleration voltage.

(3) Calculation of Number-Average Particle Diameter (D1) ("da" Described Above) of Silica Fine Particles The magnification indicator on the control panel is dragged to set the magnification to 100,000 (100 k). The [Coarse] focus knob on the operation panel is rotated. Once the image is more or less in focus, the aperture alignment is adjusted. [Align] in the control panel is clicked to display the alignment dialog box. [Beam] is selected. The "Stigma/Alignment" knobs (X, Y) on the operation panel are rotated so as to move the displayed beam to the center of the concentric circuit. [Aperture] is selected. The "Stigma/Alignment" knobs (X, Y) are turn one at a time and adjusted so as to stop or minimize image movement. The aperture dialog box is closed. Autofocus is used to adjust the focus. This operation is repeated two more times to adjust the focus.

Next, the particle diameters are measured for at least 300 silica fine particles on the toner surface. The average particle diameter is determined. Here, some of the silica fine particles are present in the form of aggregates. Thus, the number-average particle diameter (D1) (da) of primary particles of the silica fine particles is obtained by determining the maximum diameters of particles that can be confirmed to be primary particles and calculating the arithmetic mean of the resulting maximum diameters.

Method for measuring average circularity of toner particles

The average circularity of the toner particles is measured with a flow-type particle image analyzer "FPIA-3000" (manufactured by Sysmex Corporation) under the measurement and analysis conditions used in the calibration process.

The specific measurement method is described below. First, 20 mL of ion-exchanged water from which solid impurities and so forth have been removed is charged into a glass vessel. To the vessel, 0.2 mL of a dilute solution is added as a dispersant, the dilute solution being prepared by diluting "Contaminon N" (a 10% by mass aqueous solution of a neutral (pH 7) cleanser for cleaning precision analyzers, the solution containing a nonionic surfactant, an anionic surfactant, and an organic builder, available from Wako Pure Chemical Industries, Ltd.) 3 times by mass with ion-exchanged water. Then 0.02 g of the measurement sample is added. The mixture is subjected to dispersion treatment for 2 minutes with an ultrasonic disperser, thereby preparing a dispersion for measurement. Here, the dispersion is appropriately cooled in such a manner that the temperature of the dispersion is 10° C. or higher and 40° C. or lower. A desktop ultrasonic cleaner/disperser (for example, VS-150, manufactured by Velvo-Clear) having an oscillation frequency of 50 kHz and an electrical output of 150 W is used as the ultrasonic disperser. A predetermined amount of ion-exchanged water is charged into the water tank, and then 2 mL of Contaminon N is added to the water tank.

Measurement is performed with the flow-type particle image analyzer equipped with "UPlanApro" (magnification: 10×, numerical aperture: 0.40) as an objective lens. A particle sheath "PSE-900A" (manufactured by Sysmex Corporation) is used as a sheath reagent. The dispersion prepared by the procedure described above is introduced into the flow-type particle image analyzer. In the HPF measurement mode, 3000 toner particles are measured in the total count mode. The binarization threshold during particle analysis is set to 85%.

The analyzed particle diameter is limited to a circle-equivalent diameter of 1.985 μm or more and less than 39.69 μm. Thereby, the average circularity of the toner particles is determined.

For this measurement, automatic focal point adjustment is performed before the start of the measurement using reference latex particles (for example, a dilution with ion-exchanged water of "RESEARCH AND TEST PARTICLES Latex Microsphere Suspensions 5200A" from Duke Scientific). It is preferable to subsequently perform focal point adjustment every 2 hours after the start of measurement.

In the present invention, a flow-type particle image analyzer for which the calibration work has been performed by Sysmex Corporation and for which a calibration certification has been issued by Sysmex Corporation is used. Measurement is performed under the measurement and analysis conditions at the time that the calibration certificate has been issued, except that the diameters of the particles analyzed are limited to a circle-equivalent diameter of 1.985 μm or more and less than 39.69 μm.

The measurement principle employed in the flow-type particle image analyzer FPIA-3000 (manufactured by Sysmex Corporation) is to capture the flowing particles as still images and perform image analysis. The sample that has been added to the sample chamber is fed to a flat sheath flow cell with a sample suctioning syringe. The sample fed into the flat sheath flow cell is sandwiched between the sheath reagent to form a flattened flow. The sample passing through the flat sheath flow cell is irradiated with a strobe light at 1/60-second intervals, enabling the flowing particles to be captured as still images. The flow is flattened; hence, the images are captured in a focused state. The particle images are captured with a CCD camera. The captured images are subjected to image processing with a 512×512 pixel image processing resolution (0.37×0.37 μm per pixel). Contour extraction is performed on each particle image. The projected area S, the circumferential length L, and so forth are calculated for the particle image.

The circle-equivalent diameter and the circularity are determined using the surface area S and the circumferential length L. The circle-equivalent diameter refers to the diameter of the circle that has the same area as the projected area of the particle image. The circularity is defined as a value obtained by dividing the circumference of the circle determined from the circle-equivalent diameter by the circumferential length of the projected image of the particle and is calculated form the following formula:

$$\text{Circularity}=2\times(\pi\times S)^{1/2}/L$$

When the particle image is circular, the circularity is 1.000. A higher degree of unevenness of the circumference of the particle image results in a lower circularity value. After the calculation of the circularity of each particle, the range in circularity from 0.200 to 1.000 is divided by 800. The arithmetic mean of the resulting circularities is calculated. The resulting value is defined as the average circularity.

Method for Measuring Apparent Density of Silica Fine Particles

The measurement of the apparent density of the silica fine particles is performed as described below. A measurement sample on paper is slowly charged into a 100-mL graduated cylinder in such a manner that the volume reaches 100 ml. The difference is determined between the mass values of the graduated cylinder before and after the charging of the sample. The apparent density is calculated from the formula described below. When the sample is charged into the graduated cylinder, care is taken not to tap the paper.

$$\text{Apparent density (g/L)}=(\text{mass (g) upon charging 100 mL of sample}/0.1$$

Method for Measuring True Specific Gravity of Toner and Silica Fine Particles

The true specific gravities of the toner and the silica fine particles were measured with a dry automated densitometer (Autopycnometer, manufactured by Yuasa Ionics). The measurement conditions were described below.

Cell: SM cell (10 mL)

Amount of sample: 2.0 g (toner), 0.05 g (silica fine particles)

This measurement method measures the true specific gravity of solid and liquid based on a vapor-phase substitution method. As with the liquid-phase substitution method, this is based on the Archimedean principle. However, a gas (argon gas) is used as a substitution medium; hence, the method provides high precision for very small pores. Method for measuring fixation ratio of silicone oil on silica fine particles based on amount of carbon Extraction of free silicone oil (1) To a beaker, 0.50 g of the silica fine particles and 40 mL of chloroform. The mixture is stirred for 2 hours.

(2) After the stirring is stopped, the mixture is allowed to stand for 12 hours.

(3) The sample is filtered and washed three times with 40 mL of chloroform.

Measurement of Amount of Carbon

A sample is burnt at 1100° C. under a stream of oxygen. The amounts of CO and $CO_2$ generated are measured using the IR absorbance, thereby determining the amount of carbon in the sample. The amounts of carbon are compared before and after the silicone oil is extracted, the fixation ratio of the silicone oil based on the amount of carbon is calculated as described below.

(1) Into a cylindrical metal mold, 0.40 g of a sample is charged. The sample is pressed.

(2) Then 0.15 g of the pressed sample is precisely weighed, placed on a boat for combustion, and measured with EMA-110 manufactured by Horiba Ltd.

(3) [Amount of carbon after extraction of silicone oil]/[amount of carbon before extraction of silicone oil]×100 is defined as the fixation ratio of the silicone oil based on the amount of carbon. In the case where surface treatment is performed with the silicone oil after hydrophobic treatment is performed with a silane compound or the like, the amount of carbon in the sample is first measured after the hydrophobic treatment is performed with the silane compound or the like. After the surface treatment is performed with the silicone oil, the amounts of carbon are compared before and after the extraction of the silicone oil. The fixation ratio based on the amount of carbon derived from the silicone oil is calculated as described below.

(4) [Amount of carbon after extraction of silicone oil]/[(amount of carbon before extraction of silicone oil−amount of carbon after the hydrophobic treatment with silane compound or the like)]×100 is defined as the fixation ratio of the silicone oil based on the amount of carbon.

In the case where the hydrophobic treatment is performed with the silane compound or the like after the surface treatment is performed with the silicone oil, the fixation ratio based on the amount of carbon derived from the silicone oil is calculated as described below.

(5) [(Amount of carbon after extraction of silicone oil−amount of carbon after the hydrophobic treatment with silane compound or the like)]/[amount of carbon before extraction of silicone oil]×100 is defined as the fixation ratio of the silicone oil based on the amount of carbon.

Charging member

The charging member according to the present invention includes an electro-conductive substrate and an electro-conductive resin layer on the electro-conductive substrate. The electro-conductive resin layer contains a binder resin and a bowl-shaped resin particle. Hereinafter, the binder resin in the electro-conductive resin layer of the charging member is also referred to as "binder resin C".

A surface of the charging member includes a concavity derived from an opening of the bowl-shaped resin particle and a protrusion derived from the opening edge of the bowl-shaped resin particle. The charging member may have a shape, for example, a roller shape, a flat shape, or a belt shape. The structure of the charging member according to the present invention will be described below with reference to the charging roller illustrated in FIG. 1.

The charging member illustrated in FIG. 1A includes an electro-conductive substrate 1 and an electro-conductive resin layer 3 that covers the periphery of the electro-conductive substrate. The electro-conductive resin layer 3 contains binder resin C, conductive fine particles, and the bowl-shaped resin particles. As illustrated in (1*b*) of FIG. 1, the electro-conductive resin layer 3 may be formed of a first electro-conductive resin layer 31 and a second electro-conductive resin layer 32. As illustrated in (1*c* and 1*d*) of FIG. 1, at least one conductive elastic layer 2 may be provided on the inner periphery of the electro-conductive resin layer 3. The electro-conductive substrate may be bonded to a layer directly thereon with an adhesive. In this case, the adhesive is preferably conductive. To impart conductivity to the adhesive, the adhesive may contain a known conductive agent. Examples of a binder resin in the adhesive include thermosetting resins and thermoplastic resins. A known resin, for example, a urethane-, acrylic-, polyester-, polyether-, or epoxy-based resin, may be used. The conductive agent that imparts conductivity to the adhesive may be appropriately selected from conductive fine particles and ionic conductive agents described below. These may be used separately or in combination of two or more.

To achieve satisfactory chargeability of the electrophotographic photosensitive member, usually, the charging member preferably has an electrical resistance of $1\times10^{3}\Omega$ or more and $1\times10^{10}\Omega$ or less at a temperature of 23° C. and a relative humidity of 50%. The charging member preferably has a crown shape in which the diameter is maximum at the central portion in the longitudinal direction and in which the diameter decreases toward ends in the longitudinal direction from the viewpoint of achieving a uniform nip width in the longitudinal direction with respect to the electrophotographic photosensitive member. The crown height (The average of the difference between the outside diameter at the central portion and the outside diameter at positions 90 mm away from the central portion toward both ends) is preferably 30 μm or more and 200 μm or less. The surface of the charging member preferably has a hardness of 90° or less, more preferably 40° or more and 80° or less in terms of microhardness (MD-1 type). In this range, it is possible to assuredly achieve the contact between the charging member and the electrophotographic photosensitive member.

Uneven Structure of Surface of Charging Member

Figure 2A:
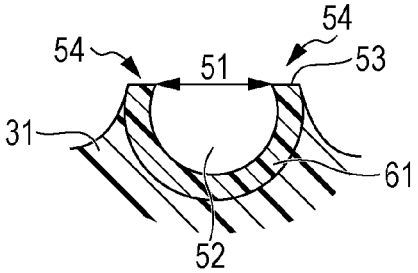
FIGS. 2A to 2D illustrate partially cross-sectional views of the vicinity of a surface of a charging member according to the present invention.
Figure 2B:
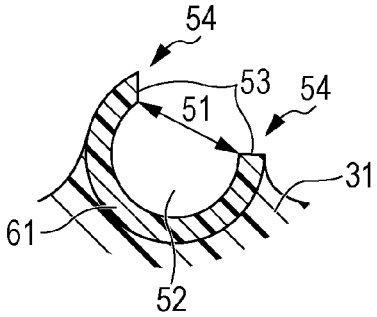

FIGS. 2A and 2B are partially cross-sectional views of the electro-conductive resin layer 31 on the surface of the charging member. In the charging member, a bowl-shaped resin particle 61 is exposed at the surface of the charging member. The surface of the charging member has a concavity 52 derived from an opening 51 of the bowl-shaped resin particle exposed at the surface and a protrusion 54 derived from an edge 53 of the opening of the bowl-shaped resin particle exposed at the surface.

Here, the "bowl-shaped resin particle" in the present invention refers to a particle having a resin shell and the spherical concavity 52, in which part of the shell is a lost portion and the lost portion forms the opening 51. The shell preferably has a thickness of 0.1 to 3 micrometers (μm). The shell preferably has a substantially uniform thickness. The substantially uniform thickness indicates that for example, the thickness of a thickest portion of the shell is three or less times and preferably two or less times the thickness of a thinnest portion. Examples of the bowl-shaped resin particle are illustrated in FIGS. 4A to 4E.

Figure 4A:
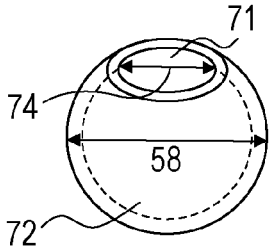
FIGS. 4A to 4E illustrate explanatory drawings of the shape of a bowl-shaped resin particle.
Figure 4B:
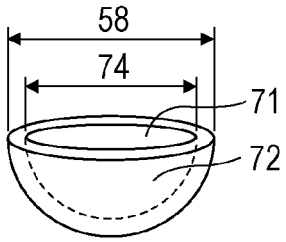
Figure 4C:
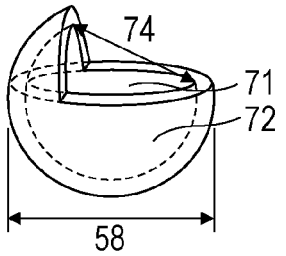
Figure 4D:
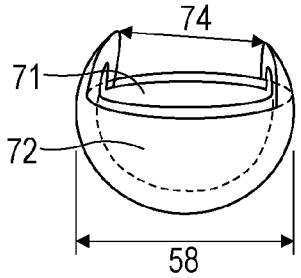
Figure 4E:
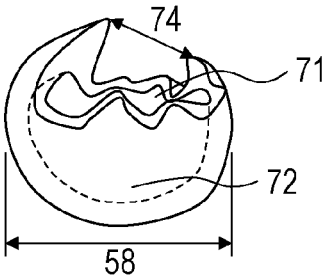

The opening 51 may have a flat edge as illustrated in FIGS. 4A and 4B or may have an uneven edge as illustrated in FIG. 4C, 4D, or 4E. The bowl-shaped resin particle preferably has a maximum diameter 58 of 5 μm or more and 150 μm or less and particularly 8 μm or more and 120 μm or less. In this range, it is possible to assuredly achieve the contact with the electrophotographic photosensitive member.

In FIGS. 4A to 4E, reference numeral 71 denotes an opening portion of the bowl-shaped resin particle. Reference numeral 74 denotes the minimum diameter of the opening portion. Reference numeral 72 denotes a roundish concavity. The presence of the roundish concavity 72 provides the elastic deformation.

Figure 2C:
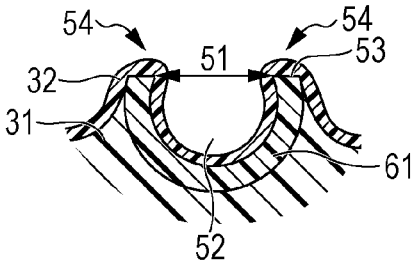
Figure 2D:
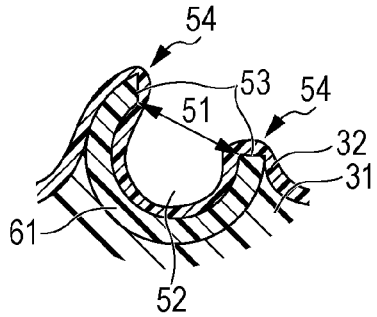

FIGS. 2C and 2D are partially cross-sectional views of surface portions of electro-conductive resin layers of the charging members, each of the charging members including the first electro-conductive resin layer 31 and the second electro-conductive resin layer 32. In each of the charging members, the bowl-shaped resin particle 61 is present so as not to be exposed at the surfaces of the charging members. More specifically, the bowl-shaped resin particle 61 has the opening portion exposed at the surface of the first electro-conductive resin layer 31, in which the edge 53 of the opening is present so as to form the protrusion. The second electro-conductive resin layer 32 (thin layer) is formed along the inner wall of the spherical concavity 52. Thus, the concavity derived from the opening of the bowl-shaped resin particle is formed on the surface of the charging member. Furthermore, the second electro-conductive resin layer (thin layer) covers the edge 53 of the opening 51. Thus, the protrusion 54 derived from the edge is formed on the surface of the charging member.

In the charging member according to the present invention, preferably, the universal hardness of the surface of the charging member decreases from the surface in an inward direction thereof. This further stabilizes the elastic deformation of the bowl-shaped resin particle and enhances the effect of inhibiting the stick-slip. A method for measuring universal hardness will be described in detail below.

The charging member according to the present invention includes the bowl-shaped resin particle and the electro-conductive resin layer, in which the surface of the charging member has the "concavity derived from the opening of the bowl-shaped resin particle" and the "protrusion derived from the edge of the opening of the bowl-shaped resin particle". In the charging member having the uneven shape, when the charging member is in contact with the photosensitive member, the protrusion derived from the opening is in contact with the photosensitive member. The concavity has a space between the photosensitive member and the concavity. The protrusion can be elastically deformed as illustrated in FIGS. 8A to 8D.

Figure 8A:
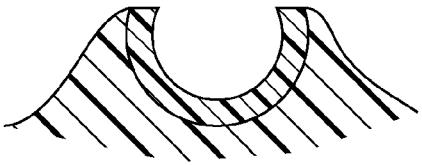
FIGS. 8A to 8D illustrate enlarged views of the vicinity of a contact portion between a charging member and an electrophotographic photosensitive member according to the present invention.
Figure 8B:
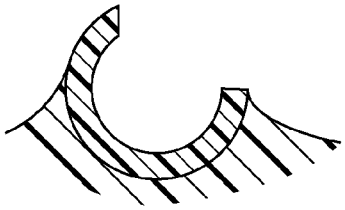
Figure 8C:
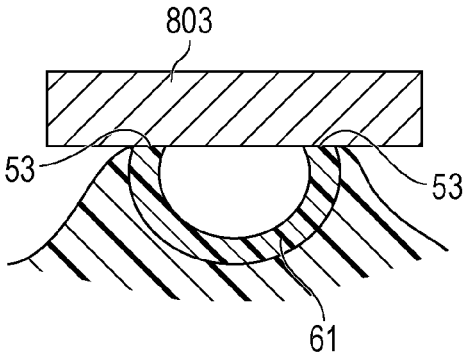
Figure 8D:
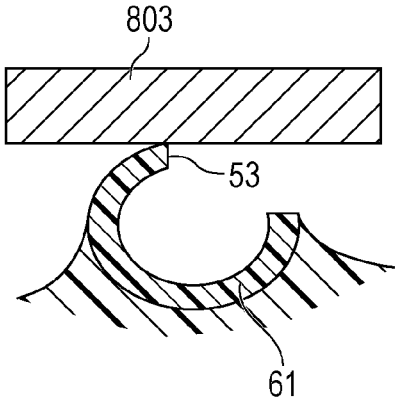

(8*a*) and (8*b*) of FIGS. 8A and 8B illustrate states before the charging members including the concavities and the protrusions illustrated in FIGS. 2A and 2B come into contact with the electrophotographic photosensitive member. FIGS. 8C and 8D illustrate nip states when the charging members including the concavities and the protrusions illustrated in FIGS. 2A and 2B are in contact with the electrophotographic photosensitive member.

It was observed that the edge 53 of the opening of the bowl-shaped resin particle 61 was elastically deformed by the contact pressure with an electrophotographic photosensitive member 803. The inventors speculate that the charging member absorbs vibration increased with a higher speed of the photosensitive member; hence, the high-speed rotation of the photosensitive member is stabilized, thereby inhibiting the occurrence of the local stick-slip of the cleaning member.

Figure 3:
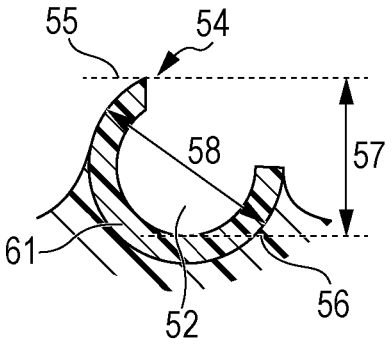
FIG. 3 is a partially cross-sectional view of the vicinity of a surface of a charging member according to the present invention.

As illustrated in FIG. 3, the difference in height 57 between the top 55 of the protrusion 54 derived from the edge of the opening of the bowl-shaped resin particle and the bottom 56 of the roundish concavity 52 defined by the shell of the bowl-shaped resin particle is preferably 5 μm or more and 100 μm or less and more preferably 8 μm or more and 80 μm or less. In this range, it is possible to assuredly achieve the contact between the charging member and the electrophotographic photosensitive member. The ratio of the maximum diameter 58 of the bowl-shaped resin particle to the difference in height 57, i.e., [maximum diameter]/[difference in height], is preferably 0.8 or more and 3.0 or less. In this range, it is possible to assuredly achieve the contact between the charging member and the electrophotographic photosensitive member.

With respect to the formation of the uneven shape, preferably, the surface state of the electro-conductive resin layer is controlled as described below. The ten point height of irregularities (Rzjis) of the surface is preferably 15 μm or more and 75 μm or less. The arithmetical mean roughness (Ra) of the surface is preferably 3.0 μm or more and 7.0 μm or less. When Rzjis and Ra is within the ranges, it is possible to assuredly achieve the contact between the charging member and the electrophotographic photosensitive member and to enhance the effect of inhibiting the micro-slip of the charging member. The average spacing of the irregularities (Sm) of the surface is preferably 20 μm or more and 200 μm or less and more preferably 30 μm or more and 150 μm or less. When Sm is within the range, the average spacing of the irregularities is short, and the number of contact points between the charging member and the electrophotographic photosensitive member is increased. It is thus possible to assuredly achieve the contact between the charging member and the electrophotographic photosensitive member. Methods for measuring the ten point height of irregularities (Rzjis), the average spacing of the irregularities (Sm), and the arithmetical mean roughness (Ra) of the surface of the charging member will be described in detail below.

The ratio of the maximum diameter 58 of the bowl-shaped resin particle to the minimum diameter 74 of the opening portion, i.e., [maximum diameter]/[minimum diameter of opening portion] of the bowl-shaped resin particle, is preferably 1.1 or more and 4.0 or less. It is thus possible to assuredly achieve the contact between the charging member and the electrophotographic photosensitive member.

Preferably, the restoring velocity of the elastic deformation of the charging member according to the present invention decreases from the surface of the charging member in an inward direction thereof. This further stabilizes the elastic deformation of the bowl-shaped resin particle and enhances the inhibition of the stick-slip of the cleaning member and the effect of inhibiting the micro-slip of the charging member.

The restoring velocity according to the present invention refers to a value indicating a restoring velocity at which the bowl-shaped resin particle present on the surface of the charging member returns from the elastic deformation to the normal state. In the case where the restoring velocity is high, the bowl-shaped resin particle is elastically deformed by the contact with the photosensitive member and then returns rapidly to the original state. In other words, a high restoring velocity indicates a large restoring force. This inhibits the fixation of the toner components to the protrusion of the bowl-shaped resin particle as described above. The toner components adhere successively to the protrusion, so that it is possible to achieve the inhibition of the micro-slip and the stabilization of the driven rotation.

The restoring velocity in an inward direction of the charging member contributes to the width of the contact between the charging member and the photosensitive member, i.e., the nip width. A low restoring velocity indicates that a deformation state due to the contact is continued to a certain amount of time. This indicates that the nip width between the charging member and the photosensitive member is increased. It is thus possible to increase the number of points in contact with the photosensitive member, reduce the pressure applied to the individual protrusions, and increase the number of the protrusions that can be elastically deformed. This enhances the inhibition of the stick-slip of the cleaning member and the effect of inhibiting the micro-slip of the charging member.

That is, the fact that the restoring velocity decreases from the surface of the charging member in an inward direction further improves the vibration-absorbing effect owing to the elastic deformation of the bowl-shaped resin particle and the effect of inhibiting the adhesion of the toner components to the protrusion of the bowl-shaped resin particle.

The restoring velocity according to the present invention is determined by a method described below. A load is applied to the elastic layer to penetrate a penetrator to a predetermined depth (D μm) with a microhardness tester based on an indentation test method according to ISO 14577 (metallic materials-instrumented indentation test for hardness and materials parameters). The predetermined depth is also referred to as the "depth of penetration". An example of the microhardness tester is "Picodentor HM500" (trade name, manufactured by Fisher Instruments).

Figure 7:
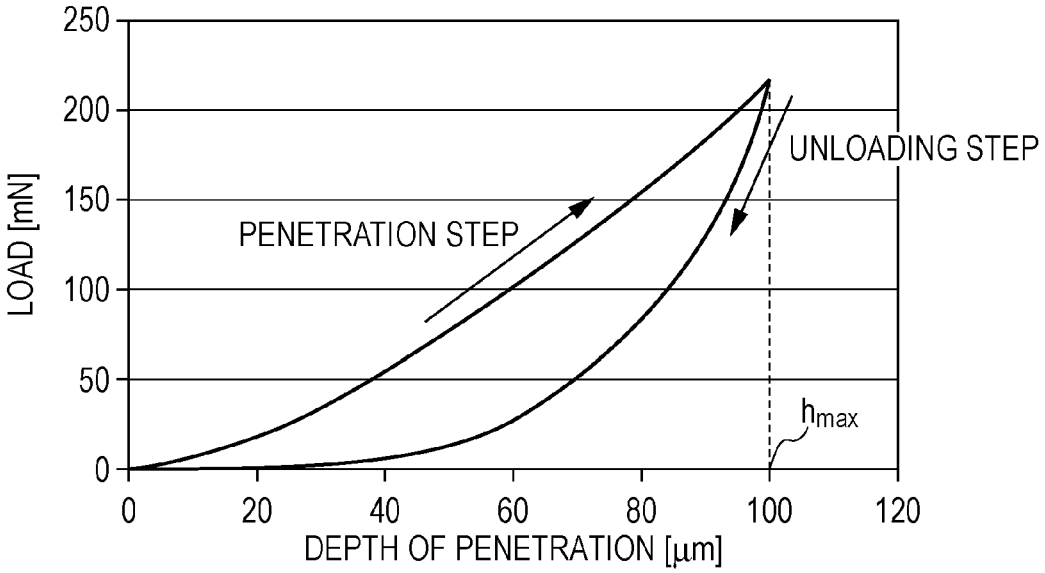
FIG. 7 is a graph illustrating an example of a load-displacement curve of a charging member according to the present invention.

The load applied to the penetrator is removed. The restoring length (μm) of the charging member is calculated on the basis of a force to which the penetrator is subjected from the charging member during an unloading step. A graph illustrating the relationship among the load (mN) applied to the penetrator, the penetration depth (μm), and the restoring length (μm) of the charging member during the unloading step is obtained as illustrated in FIG. 7.

Let the restoring length immediately after the initiation of unloading, specifically, 0.1 seconds after the initiation of unloading, be L μm, the restoring velocity v (μm/sec) is obtained from the following calculation formula (30):

$$\text{Restoring velocity } v\ (\mu m/sec) = L\ (\mu m)/0.1\ (sec) \quad (30)$$

The reason the restoring length L 0.1 seconds after the initiation of unloading is used to calculate the restoring velocity is as follows: The restoring velocity from the elastic deformation of the edge portion of the bowl-shaped resin particle is seemingly restricted to the restoring velocity immediately after the removal of a contact pressure from a surface region of the charging member. It is believed that the nip width is substantially restricted to the restoring velocity immediately after the removal of the contact pressure from the depth region (hereinafter, also referred to as a "deep region") of the charging member. In the present invention, the restoring velocity is calculated using the restoring length 0.1 seconds after the initiation of unloading. This restoring velocity is defined as the restoring velocity immediately after the removal of the contact pressure from the charging member.

The surface region according to the present invention is defined as a region extending from a surface of the charging member opposite the surface in contact with the electro-conductive substrate to a depth of 10 μm. The reason for this is that it is believed that the restoration from the elastic deformation of the edge is substantially controlled by the restoring velocity in the region extending from the surface of the charging member to the depth of 10 μm. Thus, the depth of penetration D μm of the penetrator of the microhardness tester is preferably 10 μm.

In the present invention, the deep region of the charging member is defined as a region extending from a surface of the charging member opposite the surface in contact with the base to a depth of t μm. As a guide, the depth of t is preferably about 30 μm or more and about 100 μm or less. When the value of t μm is within the range, the effect of an increase in the substantial nip width of the charging member can be assuredly provided. Thus, the depth of penetration D μm of the penetrator in the measurement of the restoring velocity of the deep region of the charging member according to the present invention is preferably 20 to 100 μm.

Electro-Conductive Resin Layer

Binder Resin C

A known rubber or resin may be used as the binder resin C in the electro-conductive resin layer of the charging member. Examples of the rubber include natural rubber, vulcanized natural rubber, and synthetic rubber. Examples of the synthetic rubber include ethylene propylene rubber, styrene-butadiene rubber (SBR), silicone rubber, urethane rubber, isoprene rubber (IR), butyl rubber, acrylonitrile-butadiene rubber (NBR), chloroprene rubber (CR), acrylic rubber, epichlorohydrin rubber, and fluorocarbon rubber. Examples of the resin that may be used include thermosetting resins and thermoplastic resins. Among these resins, fluorocarbon resins, polyamide resins, acrylic resins, polyurethane resins, acrylic-urethane resins, silicone resins, and butyral resins are more preferred. The use of the material described above further ensures the contact between the charging member and the electrophotographic photosensitive member. These may be used separately or in combination as a mixture of two or more. Monomers serving as raw materials for the binder resins may be copolymerized into copolymers.

In the case where the electro-conductive resin layer is formed of the first electro-conductive resin layer and the second electro-conductive resin layer, rubber is preferably used as the binder resin used for the first electro-conductive resin layer. This is because the contact between the charging member and the electrophotographic photosensitive member can be further ensured. In the case where rubber is used as the binder resin for the first electro-conductive resin layer, a resin is preferably used as the binder resin for the second electro-conductive resin layer. This is because the adhesion and the frictional properties between the charging member and the electrophotographic photosensitive member are easily controlled. The electro-conductive resin layer may be formed by the addition of a crosslinking agent or the like to a raw material, which has been converted into a prepolymer, for the binder resin to perform curing or crosslinking. In the case where the conductive elastic layer is provided on the inner periphery of the electro-conductive resin layer, the material for the conductive elastic layer may be the same material as the electro-conductive resin layer. In the present invention, the foregoing mixture is also referred to as a "binder resin".

Conductive Fine Particles

The electro-conductive resin layer of the charging member contains conductive fine particles in order to provide conductivity. Specific examples of the conductive fine particles include fine particles of metal oxides, metals, and carbon black. These conductive fine particles may be used alone or in combination of two or more. As a guide, the content of the conductive fine particles in the electro-conductive resin layer is in the range of 2 to 200 parts by mass and particularly 5 to 100 parts by mass based on 100 parts by mass of binder resin C. The binder resin and the conductive fine particles used for the first electro-conductive resin layer and the second electro-conductive resin layer may be the same or different.

Method for forming electro-conductive resin layer

A method for forming the electro-conductive resin layer will be described below.

Method 1: Case where Electro-Conductive Resin Layer is Formed of Single Layer (Case Illustrated in FIG. 1A)

A coating layer (hereinafter, also referred to as a "preliminary coating layer") containing the conductive fine particles and hollow resin particles dispersed in binder resin C is formed on the electro-conductive substrate. A surface of the preliminary coating layer is subjected to grinding to remove part of the hollow resin particle, thereby forming a bowl shape. The results in the formation of the concavity due to the opening of the bowl-shaped resin particle and the protrusion due to the edge of the opening of the bowl-shaped resin particle on the surface (hereinafter, also referred to as an "uneven shape due to the opening of the bowl-shaped resin particle").

1-1. Dispersion of Resin Particles in Preliminary Coating Layer

A method for dispersing the hollow resin particles in the preliminary coating layer will be described below. An example of the method is a method in which a coating film of a conductive resin composition in which hollow-shaped resin particles that contain air therein are dispersed together with binder resin C and the conductive fine particles, is formed on the electro-conductive substrate, and the coating film is dried and cured or crosslinked. Examples of a material used for the hollow resin particles include a resin serving as binder resin C and known resins.

An example of another method is a method in which what is called thermally expandable microcapsules, i.e., particles in which an encapsulated substance is contained in each of the particles and the application of heat expands the encapsulated substance to form hollow resin particles, are used. That is, a method is exemplified in which a conductive resin composition containing the thermally expandable microcapsules dispersed therein together with binder resin C and the conductive fine particles is prepared and a layer of the composition is formed on the electro-conductive substrate, dried, cured, or crosslinked. In this method, the encapsulated substance can be expanded to form hollow resin particles by heat applied during the drying, curing, or crosslinking of binder resin C used for the preliminary coating layer. In this case, the particle diameter can be controlled by controlling the temperature conditions.

In the case where the thermally expandable microcapsules are used, a thermoplastic resin needs to be used as binder resin C. Examples of the thermoplastic resin include acrylonitrile resins, vinyl chloride resins, vinylidene chloride resins, methacrylic acid resins, styrene resins, urethane resins, amide resins, methacrylonitrile resins, acrylic acid resins, acrylate resins, and methacrylate resins. Among these, a thermoplastic resin, which exhibits low gas permeability and high rebound resilience, composed of at least one selected from acrylonitrile resins, vinylidene chloride resins, and methacrylonitrile resins is preferably used. These resins are preferred because the resin particles used in the present invention are easily produced and the resin particles are easily dispersed in binder resin C. These thermoplastic resins may be used separately or in combination of two or more. Monomers serving as raw materials for the thermoplastic resins may be copolymerized into copolymers.

As the substance to be entrapped in the thermally expandable microcapsules, a substance that can be vaporized at a temperature equal to or lower than the softening point of the thermoplastic resin used as binder resin C is preferred. Examples thereof include low-boiling-point liquids, such as propane, propylene, butene, normal butane, isobutene, normal pentane, and isopentane; and high-boiling-point liquids, such as normal hexane, isohexane, normal heptane, normal octane, isooctane, normal decane, and isodecane.

The thermally expandable microcapsules may be produced by a known production method, for example, a suspension polymerization method, an interfacial polymerization method, an interfacial precipitation method, or a solvent evaporation method. For example, the suspension polymerization method is performed as follows: For example, a polymerizable monomer, the substance to be entrapped in thermally expandable microcapsules, and a polymerization initiator are mixed together. The resulting mixture is dispersed in an aqueous medium containing a surface-active agent or a dispersion stabilizer and then subjected to suspension polymerization. A compound having a reactive group capable of reacting with a functional group of the polymerizable monomer, and an organic filler may also be added.

Examples of the polymerizable monomer include acrylonitrile, methacrylonitrile, α-chloroacrylonitrile, α-ethoxyacrylonitrile, fumaronitrile, acrylic acid, methacrylic acid, itaconic acid, maleic acid, fumaric acid, citraconic acid, vinylidene chloride, vinyl acetate, acrylates (such as methyl acrylate, ethyl acrylate, n-butyl acrylate, isobutyl acrylate, tert-butyl acrylate, isobornyl acrylate, cyclohexyl acrylate, and benzyl acrylate), methacrylates (such as methyl methacrylate, ethyl methacrylate, n-butyl methacrylate, isobutyl methacrylate, tert-butyl methacrylate, isobornyl methacrylate, cyclohexyl methacrylate, and benzyl methacrylate), styrene-based monomers, acrylamide, substituted acrylamide, methacrylamide, substituted methacrylamide, butadiene, ε-caprolactam, polyethers, and isocyanates. These polymerizable monomers may be used separately or in combination of two or more.

As the polymerization initiator, any of known peroxide initiators and azo initiators may be used. Among these, an azo initiator is preferred in view of the control of the polymerization, the compatibility with a solvent, and handling safety. Specific examples of the azo initiator include 2,2'-azobisisobutyronitrile, 1,1'-azobiscyclohexane-1-carbonitrile, 2,2'-azobis-4-methoxy-2,4-dimethylvaleronitrile, and 2,2'-azobis-2,4-dimethylvaleronitrile. In particular, 2,2'-azobisisobutyronitrile is preferred in view of the efficiency of the initiator. When the polymerization initiator is used, the polymerization initiator is preferably used in an amount of 0.01 to 5 parts by mass based on 100 parts by mass of the polymerizable monomer. In this range, the effect of the polymerization initiator is provided to prepare a polymer having a sufficient degree of polymerization.

As the surfactant, for example, anionic surfactants, cationic surfactants, nonionic surfactants, amphoteric surfactants, and polymer-type dispersants may be used. When the surfactant is used, the surfactant is preferably used in an amount of 0.01 to 10 parts by mass based on 100 parts by mass of the polymerizable monomer. Examples of the dispersion stabilizer include organic fine particles (such as fine polystyrene particles, fine polymethyl methacrylate particles, fine polyacrylic acid particles, and fine polyepoxide particles), silica (such as colloidal silica), calcium carbonate, calcium phosphate, aluminum hydroxide, barium carbonate, and magnesium hydroxide. When the dispersion stabilizer is used, the dispersion stabilizer is preferably used in an amount of 0.01 to 20 parts by mass based on 100 parts by mass of the polymerizable monomer. In this range, the dispersion is stabilized. Furthermore, it is possible to prevent a problem of an increase in the viscosity of the solvent due to an increase in the amount of the dispersant that does not adsorb.

The suspension polymerization is preferably performed in a closed system with a pressure container in order to prevent the evaporation and volatilization due to the vaporization of the monomer and the solvent. After a suspension may be prepared with a disperser and then moved to the pressure container, the suspension polymerization may be performed. Alternatively, a suspension may be formed in the pressure container and then polymerized. The polymerization temperature is preferably 50° C. to 120° C. In this range, it is possible to prepare a target polymer having a sufficient degree of polymerization. The polymerization may be performed under atmospheric pressure. The polymerization is preferably performed under pressure (under pressure produced by adding 0.1 MPa to 1 MPa to atmospheric pressure) in order not to vaporize the substance to be entrapped in the thermally expandable microcapsules. After the completion of the polymerization, the product may be subjected to solid-liquid separation and washing by centrifugation and filtration. In the case where the solid-liquid separation and washing are performed, thereafter, the product may be dried and pulverized at a temperature equal to or lower than the softening temperature of the resin contained in the thermally expandable microcapsules. Drying and pulverization may be performed by known methods. An air-stream dryer, a following-wind air dryer, and a Nauta mixer may be used. The drying and pulverization may be simultaneously performed with a pulverization dryer. The surfactant and the dispersion stabilizer may be removed by repeating washing and filtration after production.

Method for forming preliminary coating layer

A method for forming the preliminary coating layer will be described below.

Examples of the method for forming the preliminary coating layer include electrostatic spray coating, dip coating, roll coating, a bonding or coating method of a sheet-shaped or tube-shaped layer having a predetermined thickness, and a method in which the material is cured and molded into a predetermined shape in a mold. In particular, when the binder resin is a rubber, the electro-conductive substrate and an unvulcanized rubber composition may integrally be extruded with an extruder equipped with a cross-head, thereby producing the preliminary coating layer. The cross-head is an extruder die provided at the tip of the extruder, the die being used to produce coating layers of electric wires and thin metal threads. After drying, curing, or crosslinking is performed, a surface of the preliminary coating layer is subjected to grinding to remove part of the hollow resin particle, thereby forming a bowl shape. Examples of a grinding method that may be employed include a cylindrical grinding method and a tape grinding method. Examples of a cylindrical grinding machine include an NC cylindrical grinding machine of a traverse system and an NC cylindrical grinding machine of a plunge cutting system.

The hollow resin particles entrap a gas in their interiors and thus have high impact resilience. Thus, as the binder resin for the preliminary coating layer, a rubber or resin having relatively low impact resilience and low elongation is preferably selected. This enables achievement of a state in which the preliminary coating layer is easily ground and the hollow resin particles are not easily ground. When the preliminary coating layer in this state is ground, only part of each of the hollow resin particles can be removed into the bowl-shaped resin particle, thereby forming the openings of the bowl-shaped resin particles on the surface of the preliminary coating layer. This method is a method in which the difference in grindability between the hollow resin particles and the preliminary coating layer is used to form the concavities derived from the openings and the protrusions derived from the edges of the openings. It is thus preferable to use a rubber as the binder resin used in the preliminary coating layer. Specifically, acrylonitrile butadiene rubber, styrene butadiene rubber, or butadiene rubber may preferably be used, the rubbers having low impact resilience and low elongation.

The hollow resin particles preferably contain a polar group-containing resin from the viewpoint of allowing the shell to have low gas permeability and high impact resilience. An example of such a resin is a resin having a unit represented by the formula (21). A resin having both the unit represented by the formula (21) and a unit represented by the formula (25) is more preferred in view of the controllability of grinding.

formula (21)

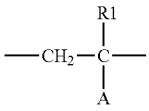

where in the formula (21), A represents at least one selected from the formulae (22), (23), and (24); and R1 represents a hydrogen atom or an alkyl group having 1 to 4 carbon atoms.

formula (22)

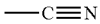

formula (23)

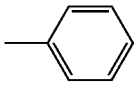

formula (24)

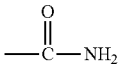

formula (25)

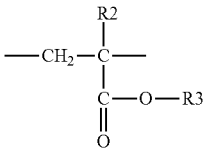

where in the formula (25), R2 represents a hydrogen atom or an alkyl group having 1 to 4 carbon atoms; and R3 represents a hydrogen atom or an alkyl group having 1 to 10 carbon atoms, R2 and R3 may have the same structure or different structures.

Grinding Method

As a grinding method, the cylindrical grinding method and the tape grinding method may be employed. A condition in which faster grinding is performed is preferred because it is necessary to markedly increase the difference in grindability between the materials. In this regard, the cylindrical grinding method is more preferably employed. From the viewpoint of achieving simultaneous grinding in the longitudinal direction to reduce the grinding time, it is more preferable to use a plunge cutting system. It is preferable that a spark-out step (a grinding step at a penetration rate of 0 mm/min), which has conventionally been performed from the viewpoint of uniformizing the ground surface, be performed in the shortest possible time or be not performed.

For example, in the case of using the cylindrical grinding machine of the plunge cutting system, the following grinding conditions for the preliminary coating layer are preferred. The number of revolutions of a cylindrical grinding wheel is preferably 1000 rpm or more and 4000 rpm or less and particularly 2000 rpm or more and 4000 rpm. The rate of penetration into the preliminary coating layer is preferably 5 mm/min or more and 30 mm/min or less and particularly 10 mm/min or more. At the end of a penetration step, a leveling step may be performed on the ground surface. The leveling step is preferably performed at a penetration rate of 0.1 mm/min to 0.2 mm/min within 2 seconds. The spark-out step (grinding step at a penetration rate of 0 mm/min) is preferably performed within 3 seconds. When the member on which the preliminary coating layer has been formed has a rotatable shape (for example, a roller shape), the number of revolutions is preferably 50 rpm or more and 500 rpm or less and particularly 200 rpm or more and 500 rpm or less. When the conditions for the penetration rate into the preliminary coating layer and the spark-out step are set as described above, it is possible to more easily form the uneven shape due to the openings of the bowl-shaped resin particles on the surface of the electro-conductive resin layer.

The roller including the ground preliminary coating layer may be used as the charging member according to the present invention without any further processing. Alternatively, a roller including the ground preliminary coating layer serving as a first electro-conductive resin layer and a second electro-conductive resin layer formed thereon may be used as the charging member according to the present invention.

Method 2: Case where Electro-Conductive Resin Layer is Formed of Two Layers (Case Illustrated in FIG. 1B)

Formation of Second Electro-Conductive Resin Layer

A surface of the first electro-conductive resin layer produced by the method described above is coated with a conductive resin composition. The conductive resin composition is dried, cured, or crosslinked to form a second electro-conductive resin layer. As a coating method, any of the foregoing methods may be employed. It is necessary to form a surface that reflects the uneven shape due to the openings and their edges of the bowl-shaped resin particles present on the surface of the first electro-conductive resin layer. Thus, the second electro-conductive resin layer preferably has a relatively small thickness. As a guide, the second electro-conductive resin layer has a thickness of 50 μm or less and particularly 30 μm or less. Among the foregoing coating methods, a method for forming the second electro-conductive resin layer by electrostatic spray coating, dip coating, or roll coating is more preferred. When any of these coating methods is employed, a conductive resin composition coating liquid containing conductive fine particles dispersed in a binder resin is prepared, and then coating is performed.

Surface Treatment

A surface of the ground preliminary coating layer or the formed second resin layer may be subjected to electron beam irradiation, ultraviolet irradiation, or heat treatment. To adjust the restoring velocity to the desired relationship, either or both of electron irradiation and heat treatment are preferably performed.

Electron Beam Irradiation

When electron beam irradiation is performed as described above, it is possible to adjust the restoring velocity to the desired relationship.

Figure 9:
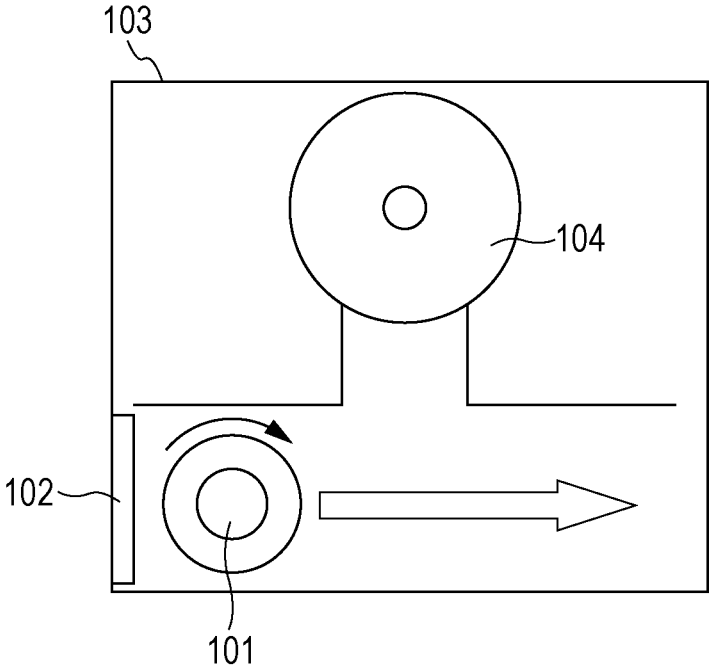
FIG. 9 is a schematic cross-sectional view of an embodiment of an electron beam irradiation apparatus used in the present invention.

FIG. 9 is a schematic drawing illustrating an example of a method in which a roller-shaped member on which an electro-conductive resin layer has been formed is irradiated with electron beams. A member 101 on which an electro-conductive resin layer has been formed is mounted on a rotary jig (not illustrated) and transported into an electron beam irradiation apparatus 103 through a charge port 102 equipped with a shutter. The shutter is then closed. An inner atmosphere of the electron beam irradiation apparatus is replaced with nitrogen. After verifying that the oxygen concentration reaches 100 ppm or less, electron beams are emitted from an electron beam generating device 104. The electron beam generating device 104 includes a vacuum chamber configured to accelerate an electron beam and a filament-shaped cathode. Heating the cathode emits thermoelectrons from its surface. The emitted thermoelectrons are accelerated by an acceleration voltage and then emerge as electron beams. Changing the shape of the filament and the heating temperature of the filament enables the number of electrons (exposure dose) emitted from the cathode to be adjusted.

The dose of the electron beams in the electron beam irradiation is defined by the following formula (31):

$$D=(K\cdot I)/V \tag{31}$$

Here, D represents a dose (kGy), K represents an apparatus constant, I represents an electron current (mA), and V represents a treatment speed (m/min). The apparatus constant K is a constant corresponding to efficiency of an individual apparatus and is an index of performance of the apparatus. The apparatus constant K may be obtained by measuring doses under a certain acceleration voltage condition with the electron current and the treatment speed changed. The dose of the electron beams is measured by attaching a dose measuring film to a surface of a roller, actually treating the roller with the electron beam irradiation apparatus, and measuring the dose of the film with a film dosimeter. A dose measuring film FWT-60 and a film dosimeter FWT-92D (both manufactured by Far West Technology, Inc.) are used. The dose of electron beams in the present invention is preferably 30 kGy or more from the viewpoint of providing the effect of surface modification and 3000 kGy or less from the viewpoint of preventing the excessive crosslinking on the surface and preventing degradation.

Ultraviolet Irradiation

A high-pressure mercury lamp, a metal halide lamp, a low-pressure mercury lamp, an excimer UV lamp, or the like may be used for the irradiation with ultraviolet rays. Among these lamps, an ultraviolet ray source rich in light having wavelengths of 150 nm or more and 480 nm or less is preferably used. Herein, the integral light quantity of ultraviolet rays is defined as follows:

$$\text{Integral light quantity of ultraviolet rays [mJ/cm}^2\text{]} = \text{ultraviolet ray intensity [mW/cm}^2\text{]} \times \text{irradiation time [s]} \tag{32}$$

The integral light quantity of ultraviolet rays may be adjusted by the irradiation time, the lamp output, and the distance between the lamp and a target object to be irradiated. The integral light quantity may have a gradient within the irradiation time.

In the case where a low-pressure mercury lamp is used, the integral light quantity of ultraviolet rays may be measured with an ultraviolet ray integral light quantity meter UIT-150-A or UVD-S254 (both are trade names) manufactured by Ushio Inc. In the case where an excimer UV lamp is used, the integral light quantity of ultraviolet rays may be measured with an ultraviolet ray integral light quantity meter UIT-150-A or VUV-S172 (both are trade names) manufactured by Ushio Inc.

Heat Treatment

The heat treatment is performed with a circulating hot air dryer or the like. Regarding heat treatment conditions, heat treatment is preferably performed for 5 minutes to 60 minutes in an atmosphere set at 180° C. to 250° C. To adjust the restoring velocity to the desired relationship, more preferably, the time is adjusted to about 5 to about 15 minutes.

Other Components in Electro-Conductive Resin Layer

The electro-conductive resin layer in the present invention may contain a known ionic conductive agent and known insulating particles in addition to the conductive fine particles described above.

Volume Resistivity of Electro-Conductive Resin Layer

As a guide, the electro-conductive resin layer preferably has a volume resistivity of $1\times10^2$ Ω·cm or more and $1\times10^{16}$ Q·cm or less in an environment at a temperature of 23° C. and a relative humidity of 50%. In this range, it is easier to appropriately charge the electrophotographic photosensitive member by discharging.

The volume resistivity of the electro-conductive resin layer is determined as described below. The electro-conductive resin layer is cut out from the charging member into a strip having a length of about 5 mm, a width of about 5 mm, and a thickness of about 1 mm. A metal is deposited by evaporation on both sides of the strip to form an electrode and a guard electrode, thereby preparing a measurement sample. In the case where the electro-conductive resin layer is a thin film and thus is not cut out, a conductive resin composition used to form the electro-conductive resin layer is applied to an aluminum sheet to form a coating film. The metal is deposited by evaporation to provide a measurement sample. A voltage of 200 V is applied to the measurement sample with a micro-current meter (trade name: ADVANTEST R8340A ultra-high resistance meter, manufactured by Advantest Co., Ltd). A current is measured 30 seconds later. The volume resistivity is determined by calculation from the thickness and the electrode area. The volume resistivity of the electro-conductive resin layer may be adjusted by the use of the conductive fine particles and the ionic conductive agent described above. As a guide, the conductive fine particles have an average particle diameter of 0.01 μm to 0.9 μm and particularly 0.01 μm to 0.5 μm. As a guide, the electro-conductive resin layer has a conductive fine particle content of 2 to 80 parts by mass and particularly 20 to 60 parts by mass based on 100 parts by mass of binder resin C.

Electro-Conductive Substrate

The electro-conductive substrate used in the charging member according to the present invention has electrical conductivity and the function of supporting the electro-conductive resin layer and so forth provided thereon. Examples of a material for the electro-conductive substrate include metals, such as iron, copper, stainless steel, aluminum, and nickel, and alloys thereof.

Volume Resistivity

The electro-conductive resin layer used on the surface of the charging member according to the present invention preferably has a volume resistivity of $1\times10^{2}$ Ω·cm or more and $1\times10^{16}$ Ω·cm or less in an environment at a temperature of 23° C. and a relative humidity of 50%. In this range, it is easier to appropriately charge the electrophotographic photosensitive member by discharging.

The volume resistivity of the electro-conductive resin layer is determined as described below. The electro-conductive resin layer is cut out from the charging member into a strip having a length of about 5 mm, a width of about 5 mm, and a thickness of about 1 mm. A metal is deposited by evaporation on both sides of the strip to form a measurement sample. In the case where the electro-conductive resin layer is a thin film and thus is not cut out, a conductive resin composition used to form the electro-conductive resin layer is applied to an aluminum sheet to form a coating film. The metal is deposited by evaporation to provide a measurement sample. A voltage of 200 V is applied to the measurement sample with a micro-current meter (trade name: ADVANTEST R8340A ultra-high resistance meter, manufactured by Advantest Co., Ltd). A current is measured 30 seconds later. The volume resistivity is determined by calculation from the thickness and the electrode area. The volume resistivity of the electro-conductive resin layer may be adjusted by the use of the conductive fine particles.

The conductive fine particles preferably have an average particle diameter of 0.01 μm to 0.9 μm and more preferably 0.01 μm to 0.5 μm. In the ranges, it is easy to control the volume resistivity of the electro-conductive resin layer.

Image-Forming Apparatus

Figure 6:
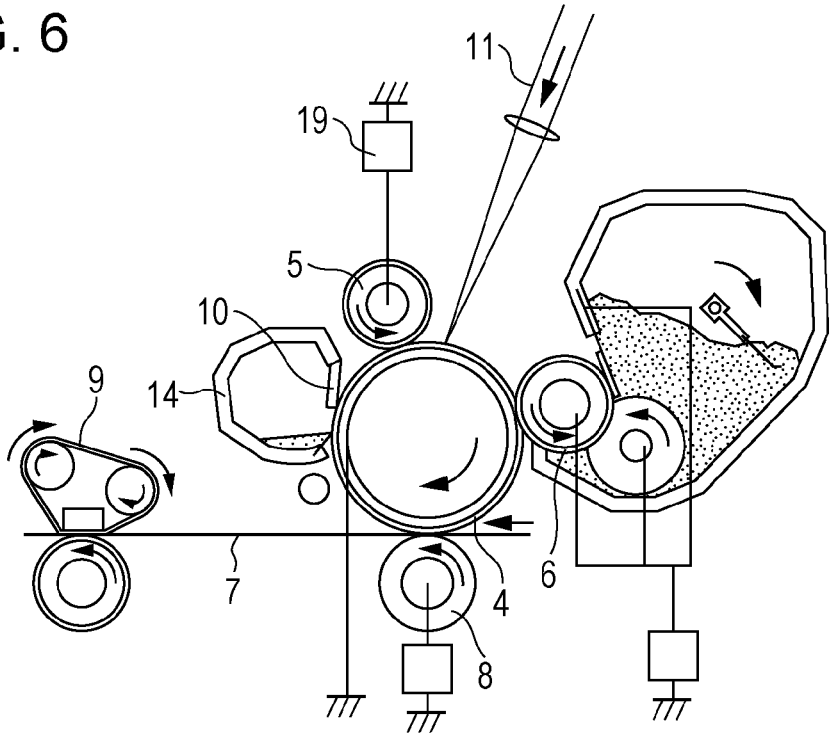
FIG. 6 is a schematic cross-sectional view of an image-forming apparatus according to an embodiment of the present invention.

FIG. 6 illustrates a schematic structure of an image-forming apparatus according to an embodiment of the present invention.

The image-forming apparatus includes a photosensitive member, a charging device (charging means) configured to charge the photosensitive member with a charging member, an exposure device (exposure means) configured to form an electrostatic latent image on a surface of the charged photosensitive member, a developing device (developing means) configured to supply the photosensitive member on which the electrostatic latent image is formed with a toner to form a toner image on the surface of the photosensitive member, and a cleaning device (cleaning means) before the charging means, the cleaning device being configured to recover a residual toner. The image-forming apparatus illustrated in FIG. 6 further includes a transfer device (transfer means) configured to transfer the toner image to a transfer material, a fixing device (fixing means) configured to fix the toner image, and so forth.

A photosensitive member 4 is of a rotating drum type having a photosensitive layer on the periphery of the electro-conductive substrate. The photosensitive member is rotatably driven at a predetermined circumferential velocity (process speed) in the direction indicated by an arrow.

The charging device includes a contact-type charging roller 5 provided in contact with the photosensitive member 4 at a predetermined pressing force. The charging roller 5 is rotated by the rotation of the electrophotographic photosensitive member, i.e., driven rotation. A predetermined voltage is applied from a charging power source 19 to charge the electrophotographic photosensitive member to a predetermined potential.

As a latent image forming device 11 configured to form an electrostatic latent image on the photosensitive member 4, for example, an exposure device, such as a laser beam scanner, is used. The uniformly charged photosensitive member is exposed to light in response to image information to form the electrostatic latent image.

The developing device includes a developing sleeve or developing roller 6 arranged close to or in contact with the photosensitive member 4. The electrostatic latent image is developed by reverse development with a toner that has electrostatically been processed to have the same polarity as charge polarity of the photosensitive member, thereby forming a toner image.

The transfer device includes a contact-type transfer roller 8. The toner image is transferred from the photosensitive member to a transfer material 7, such as plain paper, (the transfer material is transported by a paper feed system having a transport member).

The cleaning device includes a blade-type cleaning member 10 and a recovery container 14. After the transfer, a transfer residual toner left on the photosensitive member is mechanically scraped and recovered.

The fixing device 9 includes a roll and so forth to be kept heated. The fixing device 9 fixes the transferred toner image to the transfer material 7 and then delivers the transfer material 7 to the outside of the apparatus.

Process Cartridge

Figure 10:
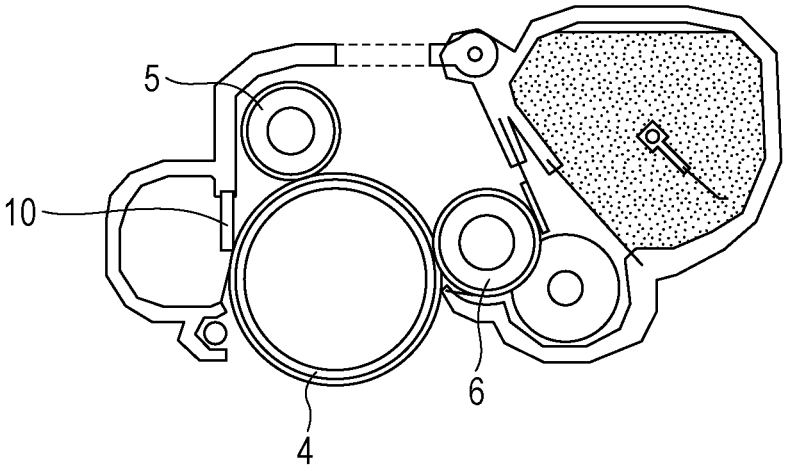
FIG. 10 is a schematic cross-sectional view of a process cartridge according to an embodiment of the present invention.

A process cartridge (FIG. 10) integrally supporting a photosensitive member, a charging device (charging means), a developing device (developing means), and a cleaning device (cleaning means) may be used, the process cartridge being configured to be detachably attached to an image-forming apparatus.

The image-forming apparatus may include a process cartridge, an exposure device, and a developing device provided with the developing member 6, in which the process cartridge may be the foregoing process cartridge.

EXAMPLES

The present invention will be described in more detail below by examples.

Production examples of a magnetic material, a polyester resin, toner particles, and a toner, methods for evaluating a charging member and resin particles, and production examples of the resin particles, a conductive rubber, and the charging member are described.

Regarding the following particles, an "average particle diameter" indicates a "volume-average particle diameter" unless otherwise specified. In examples and comparative examples, "part(s)" and "%" are on a mass basis unless otherwise specified.

Production Example of Magnetic Material 1

To an aqueous solution of ferrous sulfate, 1.00 to 1.10 equivalents of a caustic soda solution on an elemental iron basis, 0.15% by mass of $P_2O_5$ in terms of elemental phosphorus on an elemental iron basis, and 0.50% by mass of $SiO_2$ in terms of elemental silicon on an elemental iron basis were added, thereby preparing an aqueous solution containing ferrous hydroxide. The pH of the aqueous solution containing ferrous hydroxide was adjusted to 8.0. An oxidation reaction was performed at 85° C. with air blown into the mixture, thereby preparing a slurry containing seed crystals.

Next, 0.90 to 1.20 equivalents of an aqueous solution of ferrous hydroxide based on the initial amount of alkali (sodium component of caustic soda) was added to the slurry. The slurry was maintained at pH 7.6. An oxidation reaction was allowed to proceed with air blown into the mixture, thereby preparing a slurry containing magnetic iron oxide. After filtration and washing, the water-containing slurry was temporarily removed. At this time, a small amount of the water-containing sample was collected. The water content was measured. The water-containing sample was not subjected to drying and then was poured into another aqueous medium. The resulting slurry was stirred. The slurry was re-dispersed therein with a pin mill while being circulated. The pH of the re-dispersion was adjusted to 4.8. Next, 1.6 parts by mass of a n-hexyltrimethoxysilane coupling agent based on 100 parts by mass of magnetic iron oxide was added thereto under stirring (the amount of magnetic iron oxide was calculated as a value obtained by subtracting the water content from the water-containing sample) to perform hydrolysis. Stirring was sufficiently performed. The pH of the dispersion was adjusted to 8.6. Surface treatment was performed. The resulting hydrophobic magnetic material was filtered with a filter press and rinsed with a large amount of water. The hydrophobic magnetic material was dried at 100° C. for 15 minutes and then at 90° C. for 30 minutes. The resulting particles were subjected to disaggregation treatment, thereby providing magnetic material 1 having a volume-average particle diameter of 0.21 μm.

Production Example of Polyester Resin 1 vessel equipped with a condenser, a stirrer, and a nitrogen inlet. The reaction was performed at 230° C. for 10 hours under a stream of nitrogen while water formed was distilled off.

| | |
|---|---|
| Propylene oxide (2 mol) adduct of Bisphenol A | 75 parts by mass |
| Propylene oxide (3 mol) adduct of Bisphenol A | 25 parts by mass |
| Terephthalic acid | 100 parts by mass |
| Titanium-based catalyst (titanium dihydroxybis(triethanolaminate)) | 0.25 parts by mass |

Next, the reaction was performed under a reduced pressure of 5 to 20 mmHg. When the acid value was reduced to 2 mgKOH/g or less, the mixture was cooled to 180° C. Then 10 parts by mass of trimellitic anhydride was added thereto. The reaction was performed for 2 hours at normal pressure in a sealed state. The product was then removed, cooled to room temperature, and pulverized to provide polyester resin 1. Polyester resin 1 was subjected to gel permeation chromatography (GPC) and found to have a main peak molecular weight (Mp) of 10,500.

Production Example of Toner Particles 1

To 720 parts by mass of ion-exchanged water, 450 parts by mass of a 0.1 M aqueous solution of $Na_3PO_4$ was added. After the mixture was heated to 60° C., 67.7 parts by mass of a 1.0 M aqueous solution of $CaCl_2$ was added thereto, thereby preparing an aqueous medium containing a dispersion stabilizer.

| | |
|---|---|
| Styrene | 78.0 parts by mass |
| n-Butyl acrylate | 22.0 parts by mass |
| Divinylbenzene | 0.6 parts by mass |
| Iron complex of monoazo dye (T-77, from Hodogaya Chemical Co., Ltd.) | 3.0 parts by mass |
| Magnetic material 1 | 90.0 parts by mass |
| Polyester resin 1 | 5.0 parts by mass |

The formulation described above was uniformly dispersed and mixed using an attritor (Mitsui Miike Chemical Engineering Machinery) to provide a polymerizable monomer composition. The resulting polymerizable monomer composition was heated to 60° C., and then 15.0 parts by mass of Fischer-Tropsch wax (melting point: 74° C., number-average molecular weight Mn: 500) was added thereto and dissolved therein. After dissolving the Fischer-Tropsch wax in the polymerizable monomer composition, 7.0 parts by mass of dilauroyl peroxide serving as a polymerization initiator was dissolved therein, providing a toner composition.

The toner composition was added to the foregoing aqueous medium. The mixture was granulated by stirring at 60° C. in a $N_2$ atmosphere with a TK Homomixer (Tokushu Kika Kogyo Co., Ltd.) at 12,000 rpm for 10 minutes. The reaction was performed at 74° C. for 6 hours under stirring with a paddle-type impeller. After the completion of the reaction, the suspension was cooled, washed by the addition of hydrochloric acid, filtered, and dried to provide toner particles 1. Table 1 describes the physical properties of magnetic toner particles 1.

Production Example of Toner Particles 2

| | |
|---|---|
| Styrene-acrylic copolymer (the ratio by mass of styrene to n-butyl acrylate: 78.0:22.0, main peak molecular weight Mp: 10,000) | 100 parts by mass |
| Magnetic material 1 | 90 parts by mass |
| Iron complex of monoazo dye (T-77, from Hodogaya Chemical Co., Ltd.) | 2 parts by mass |
| Fischer-Tropsch wax (melting point: 74° C., number-average molecular weight Mn: 500) | 4 parts by mass |

The mixture described above was premixed using a Henschel mixer and melt-kneaded with a twin-screw extruder heated to 110° C. The kneaded mixture was cooled and roughly ground with a hammer mill to provide roughly ground toner particles. The resulting roughly ground particles were mechanically pulverized (finely ground) with a mechanical pulverizer (Turbo Mill, manufactured by Turbo Industry Ltd., rotor and stator surfaces were plated with chromium alloy containing chromium carbide (plating thickness: 150 μm, surface hardness HV: 1050)). The pulverized particles were subjected to classification to remove a fine power and a coarse powder at the same time with a multi-division classifier that utilizes the Coanda effect (manufactured by Nittetsu Mining Co., Ltd., ELBOW-JET classifier).

A surface modification device (Faculty, from Hosokawa Micron Corporation) was used to perform the surface modification of the raw material toner particles and to remove a fine powder, thereby providing toner particles 2. Regarding conditions for the surface modification and the removal of the fine powder with the surface modification device, the circumferential velocity of the dispersing rotor was 150 m/sec. The amount of the pulverized product was 7.6 kg per cycle. The surface modification time (cycle time: time from the end of the supply of the raw material to the opening of a discharge valve) was 82 seconds. The temperature at the time of the discharge of the toner particles was 44° C. Table 1 describes the physical properties of toner particles 2.

TABLE 1

| Toner particle | Weight-average particle diameter (D4) (μm) | Average circularity |
|---|---|---|
| Toner particle 1 | 8.0 | 0.970 |
| Toner particle 2 | 8.0 | 0.938 |

Production Examples of Toners A1 to A12, and A13 to A18

Production Example Toner A1

Toner particles 1 described above was subjected to external addition and mixing treatment using the apparatus illustrated in FIG. 13.

In this example, the apparatus illustrated in FIG. 13 was used. The inner peripheral portion of the main casing 201 had a diameter of 130 mm. The processing space 209 had a volume of $2.0\times10^{-3}$ $m^3$. The drive member 208 had a rated power of 5.5 kW. The stirring members 203 had a shape as illustrated in FIG. 14. The width of overlap d between the stirring members 203*a* and 203*b* in FIG. 14 was set to 0.25 D based on the maximum width D of the stirring members 203. The clearance between the stirring members 203 and the inner periphery of the main casing 201 was set to 3.0 mm.

Into the apparatus illustrated in FIG. 13, 100 parts by mass of toner particles 1 and 0.50 parts by mass of silica fine particles 1 described in Table 2 (number-average particle diameter of primary particles of silica raw material: 7 nm, number-average particle diameter of primary particles of silica fine particles after treatment: 8 nm) were charged, the apparatus having the foregoing structure.

After charging the toner particles and the silica fine particles, premixing was performed in order to uniformly mix the toner particles and the silica fine particles. As the premixing conditions, the power of the drive member 208 was set to 0.10 W/g (number of revolutions of drive member 208: 150 rpm), and the treatment time was set to 1 minute.

After the completion of premixing, external addition and mixing treatment was performed. Regarding the conditions for the external addition and mixing treatment, the processing time was 5 minutes, and the circumferential velocity of the outermost end of the stirring members 203 was adjusted so as to maintain the power of the drive member 208 to be 0.60 W/g (number of revolutions of drive member 208: 1400 rpm). Table 3 describes the external addition and mixing treatment conditions.

After the external addition and mixing treatment, the coarse particles and so forth were removed using a circular oscillating sieve having a diameter of 500 mm and an opening of 75 μm, providing toner A1. Toner A1 was magnified and observed with a scanning electron microscope. The number-average particle diameter of primary particles of the silica fine particles on the toner surface was measured and found to be 8 nm. Table 3 describes the external addition conditions and the physical properties of toner A1.

Production Example of Toner A2 to A12

Toners A2 to A12 were produced as in Production example of toner A1, except that the type and the number of parts of silica fine particles added, the toner particles, the external addition conditions, and so forth were changed as described in Tables 2 and 3. Table 3 describes the external addition conditions and the physical properties of toners A2 to A12.

Production Example of Toner a13 to a18

Toners a13 to a18 were produced as in Production example of toner A1, except that the type and the number of parts of silica fine particles added, the toner particles, the external addition apparatus, the external addition conditions, and so forth were changed as described in Tables 2 and 3. Table 3 describes the external addition conditions and the physical properties of toners a13 to a18.

In the case where a Henschel mixer was used as the external addition apparatus, an FM10C Henschel mixer (Mitsui Miike Chemical Engineering Machinery) was used. In some production examples, the premixing step was not performed.

Figure 12:
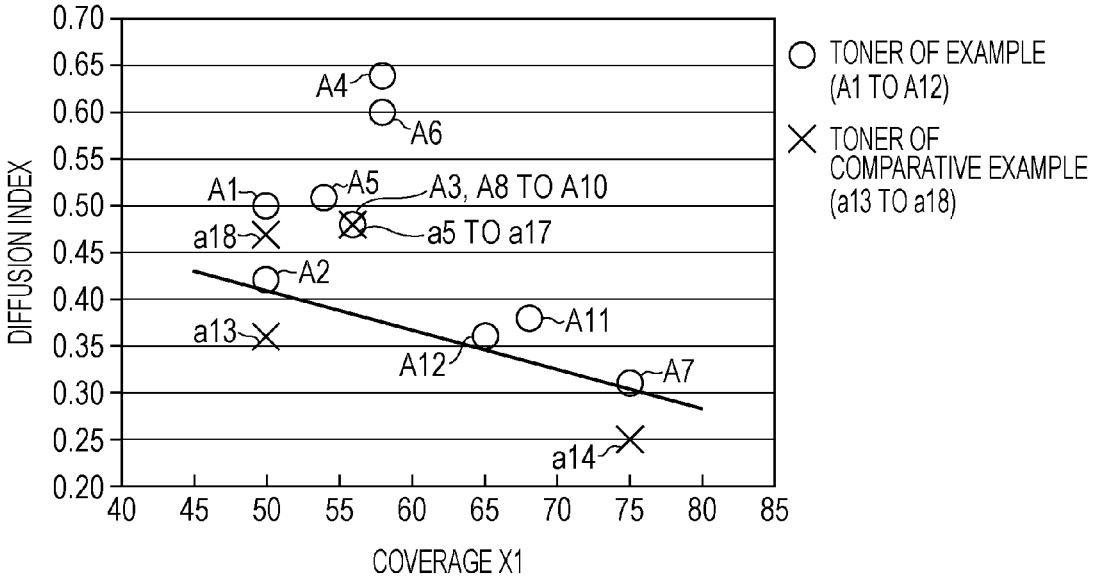
FIG. 12 is a plot of the coverage ratio X1 versus the diffusion index of a toner according to the present invention.

FIG. 12 is a plot of the coverage ratio X1 versus the diffusion index of toners A1 to A12 and toners a13 to a18. The toners used in examples are represented by "○".

The toners used in comparative examples are represented by "x".

TABLE 2

| Silica fine particle | BET specific surface area of silica raw material ($m^2$/g) | Number of parts of silicone oil used for treatment based on 100 parts by mass of silica raw material (parts by mass) | Kinematic viscosity of silicone oil (cSt) | Fixation ratio of silicone oil based on amount of carbon (%) | Apparent density (g/L) |
|---|---|---|---|---|---|
| Silica fine particle 1 | 300 | 20 | 50 | 98 | 25 |
| Silica fine particle 2 | 300 | 20 | 50 | 98 | 60 |
| Silica fine particle 3 | 130 | 18 | 50 | 98 | 33 |
| Silica fine particle 4 | 100 | 17 | 50 | 98 | 40 |
| Silica fine particle 5 | 380 | 28 | 50 | 98 | 20 |
| Silica fine particle 6 | 300 | 15 | 50 | 98 | 25 |
| Silica fine particle 7 | 300 | 40 | 50 | 98 | 25 |
| Silica fine particle 8 | 300 | 20 | 50 | 70 | 25 |
| Silica fine particle 9 | 300 | 13 | 50 | 98 | 25 |

TABLE 2-continued

| Silica fine particle | BET specific surface area of silica raw material ($m^2/g$) | Number of parts of silicone oil used for treatment based on 100 parts by mass of silica raw material (parts by mass) | Kinematic viscosity of silicone oil (cSt) | Fixation ratio of silicone oil based on amount of carbon (%) | Apparent density (g/L) |
|---|---|---|---|---|---|
| Silica fine particle 10 | 300 | 45 | 50 | 98 | 25 |
| Silica fine particle 11 | 300 | 20 | 50 | 60 | 25 |
| Silica fine particle 12 | 50 | 15 | 50 | 98 | 55 |

TABLE 3

| Toner | Toner particle | Silica fine particle | Number of parts of silica fine particles added (parts by mass) | Content of silica fine particles (parts by mass) | External addition apparatus | Premixing step | External addition step | Coverage ratio X1 (area %) | Diffusion index | (Formula 2) −0.0042 × X1 + 0.62 |
|---|---|---|---|---|---|---|---|---|---|---|
| Toner A1 | Toner particle 1 | Silica fine particle 1 | 0.50 | 0.50 | Apparatus in FIG. 13 | 0.10 W/g (150 rpm) | 0.60 W/g (1400 rpm) | 50 | 0.50 | 0.41 |
| Toner A2 | Toner particle 1 | Silica fine particle 1 | 0.60 | 0.60 | Apparatus in FIG. 13 | 0.06 W/g (50 rpm) | 0.60 W/g (1400 rpm) | 50 | 0.42 | 0.41 |
| Toner A3 | Toner particle 1 | Silica fine particle 2 | 0.60 | 0.60 | Apparatus in FIG. 13 | 0.10 W/g (150 rpm) | 0.60 W/g (1400 rpm) | 56 | 0.48 | 0.3848 |
| Toner A4 | Toner particle 1 | Silica fine particle 4 | 1.30 | 1.30 | Apparatus in FIG. 13 | 0.06 W/g (50 rpm) | 0.60 W/g (1400 rpm) | 58 | 0.64 | 0.3764 |
| Toner A5 | Toner particle 1 | Silica fine particle 5 | 0.40 | 0.40 | Apparatus in FIG. 13 | 0.06 W/g (50 rpm) | 0.60 W/g (1400 rpm) | 54 | 0.51 | 0.3932 |
| Toner A6 | Toner particle 1 | Silica fine particle 3 | 1.10 | 1.10 | Apparatus in FIG. 13 | 0.06 W/g (50 rpm) | 0.60 W/g (1400 rpm) | 58 | 0.60 | 0.3764 |
| Toner A7 | Toner particle 1 | Silica fine particle 1 | 1.20 | 1.20 | Apparatus in FIG. 13 | 0.06 W/g (50 rpm) | 0.60 W/g (1400 rpm) | 75 | 0.31 | 0.305 |
| Toner A8 | Toner particle 1 | Silica fine particle 6 | 0.60 | 0.60 | Apparatus in FIG. 13 | 0.10 W/g (150 rpm) | 0.60 W/g (1400 rpm) | 56 | 0.48 | 0.3848 |
| Toner A9 | Toner particle 1 | Silica fine particle 7 | 0.60 | 0.60 | Apparatus in FIG. 13 | 0.10 W/g (150 rpm) | 0.60 W/g (1400 rpm) | 56 | 0.48 | 0.3848 |
| Toner A10 | Toner particle 1 | Silica fine particle 8 | 0.60 | 0.60 | Apparatus in FIG. 13 | 0.10 W/g (150 rpm) | 0.60 W/g (1400 rpm) | 56 | 0.48 | 0.3848 |
| Toner A11 | Toner particle 2 | Silica fine particle 1 | 0.90 | 0.90 | Apparatus in FIG. 13 | 0.10 W/g (150 rpm) | 0.60 W/g (1400 rpm) | 68 | 0.38 | 0.3344 |
| Toner A12 | Toner particle 1 | Silica fine particle 1 | 0.90 | 0.90 | Apparatus in FIG. 13 | 0.06 W/g (50 rpm) | 0.60 W/g (1400 rpm) | 65 | 0.36 | 0.347 |
| Toner A13 | Toner particle 1 | Silica fine particle 1 | 0.70 | 0.70 | Henschel mixer | no | 4000 rpm | 50 | 0.36 | 0.41 |
| Toner A14 | Toner particle 1 | Silica fine particle 1 | 1.50 | 1.50 | Henschel mixer | no | 4000 rpm | 75 | 0.25 | 0.305 |
| Toner A15 | Toner particle 1 | Silica fine particle 9 | 0.60 | 0.60 | Apparatus in FIG. 13 | 0.10 W/g (150 rpm) | 0.60 W/g (1400 rpm) | 56 | 0.48 | 0.3848 |
| Toner A16 | Toner particle 1 | Silica fine particle 10 | 0.60 | 0.60 | Apparatus in FIG. 13 | 0.10 W/g (150 rpm) | 0.60 W/g (1400 rpm) | 56 | 0.48 | 0.3848 |
| Toner A17 | Toner particle 1 | Silica fine particle 11 | 0.60 | 0.60 | Apparatus in FIG. 13 | 0.10 W/g (150 rpm) | 0.60 W/g (1400 rpm) | 56 | 0.48 | 0.3848 |
| Toner A18 | Toner particle 1 | Silica fine particle 12 | 2.00 | 2.00 | Henschel mixer | no | 4000 rpm | 50 | 0.47 | 0.41 |

Production Examples of Resin Particles b1 to b10

Production Example b1

First, 4000 parts by mass of ion-exchanged water, 9 parts by mass of colloidal silica, and 0.15 parts by mass of polyvinylpyrrolidone, which were dispersion stabilizers, were mixed together to prepare an aqueous mixture. Next, 50 parts by mass of acrylonitrile, 45 parts by mass of methacrylonitrile, and 5 parts by mass of methyl methacrylate, which were polymerizable monomers, 12.5 parts by mass of normal hexane serving as an encapsulated substance, and 0.75 parts by mass of dicumyl peroxide serving as a polymerization initiator were mixed together to prepare an oily mixture. The oily mixture was added to the aqueous mixture. Furthermore, 0.4 parts by mass of sodium hydroxide was added thereto, thereby preparing a dispersion. The resulting dispersion was stirring and mixed using a homogenizer for 3 minutes. The dispersion was fed to a polymerization reactor filled with nitrogen. The dispersion was allowed to react under stirring at 200 rpm and 60° C. for 20 hours to prepare a reaction product. The resulting reaction product was filtered and repeatedly washed with water. Then the filtered product was dried at 80° C. for 5 hours to produce resin particles. The resulting resin particles were disaggregated and classified with an acoustic classifier, thereby providing resin particles b1 having an average particle diameter of 12 μm.

Production Example b2

Resin particles were produced as in Production example b1, except that the amount of parts of colloidal silica added was changed to 4.5 parts by mass. The resin particles were similarly classified to provide resin particles b2 having an average particle diameter of 50 μm.

Production Example b3 to b6

Particles which were classified in Production example b2 and which had different average particle diameters described in Table 4 were defined as resin particles b3 to b6.

TABLE 4

| Resin particle No. | Average particle diameter (μm) |
|---|---|
| b3 | 60 |
| b4 | 10 |
| b5 | 40 |
| b6 | 15 |

Production Example b7

Resin particles were produced as in Production example b1, except that the polymerizable monomers were changed to 45 parts by mass of methacrylonitrile and 55 parts by mass of methyl acrylate. The resin particles were classified to provide resin particles b7 having an average particle diameter of 25 μm.

Production Example b8

Resin particles were produced as in Production example b2, except that the polymerizable monomers were changed to 45 parts by mass of acrylamide and 55 parts by mass of methacrylamide. The resin particles were classified to provide resin particles b8 having an average particle diameter of 45 μm.

Production Example b9

Resin particles were produced as in Production example b2, except that the polymerizable monomers were changed to 60 parts by mass of methyl methacrylate and 40 parts by mass of acrylamide. The resin particles were classified to provide resin particles b9 having an average particle diameter of 10 μm.

Production Example b10

Resin particles were produced as in Production example b1, except that the polymerizable monomers were changed to 100 parts by mass of acrylamide. The resin particles were classified to provide resin particles b10 having an average particle diameter of 8 μm.

Method for Producing Conductive Rubber Composition c1 to c16

Production Example c1

To 100 parts by mass of acrylonitrile-butadiene rubber (NBR) (trade name: N230SV, manufactured by JSR Corp.), other four materials described in the row of Component (1) in Table 5 were added. The mixture was kneaded for 15 minutes with a closed mixer adjusted at 50° C. Three materials described in the row of Component (2) in Table 5 were added to the mixture. Subsequently, the mixture was kneaded for 10 minutes with a two-roll mill cooled to 25° C., thereby producing conductive rubber composition c1.

TABLE 5

| | Material | Parts by mass |
|---|---|---|
| Component (1) | acrylonitrile-butadiene rubber (NBR) (trade name: N230SV, manufactured by JSR Corporation) | 100 |
| | carbon black (trade name: TOKABLACK #7360SB, manufactured by Tokai Carbon Co., Ltd.) | 48 |
| | zinc stearate (trade name: SZ-2000, manufactured by Sakai Chemical Industry Co., Ltd.) | 1 |
| | zinc oxide (trade name: Zinc White No. 2, manufactured by Sakai Chemical Industry Co., Ltd.) | 5 |
| | calcium carbonate (trade name: Silver W, Shiraishi Kogyo Kaisha, Ltd.) | 20 |
| Component (2) | resin particle b1 | 12 |
| | sulfur (vulcanizing agent) | 1.2 |
| | tetrabenzylthiuram disulfide (TBzTD) (trade name: Perkacit TBzTD, manufactured by Flexsys, vulcanization accelerator) | 4.5 |

Production Example c2

Conductive rubber composition c2 was produced as in Production Example c1, except that resin particles b1 was changed to resin particles b2.

Production Examples c3 to c8

Conductive rubber compositions c3 to c8 were produced as in Production Example c1, except that the type and the amount of parts of the resin particles were changed as described in Table 8.

Production Example c9

To 100 parts by mass of styrene-butadiene rubber (SBR) (trade name: SBR1500, manufactured by JSR Corp.), other six materials described in the row of Component (1) in Table 6 were added. The mixture was kneaded for 15 minutes with a closed mixer adjusted at 80° C. Three materials described in the row of Component (2) in Table 6 were added to the mixture. Subsequently, the mixture was kneaded for 10 minutes with a two-roll mill cooled to 25° C., thereby producing conductive rubber composition c9.

TABLE 6

| | Material | Parts by mass |
|---|---|---|
| Component (1) | styrene-butadiene rubber (SBR) (trade name: N230SV, manufactured by JSR Corporation) | 100 |
| | zinc oxide (trade name: Zinc White No. 2, manufactured by Sakai Chemical Industry Co., Ltd.) | 5 |
| | zinc stearate (trade name: SZ-2000, manufactured by Sakai Chemical Industry Co., Ltd.) | 2 |
| | carbon black (trade name: Ketjenblack EC600JD, manufactured by Lion Corporation) | 8 |
| | carbon black (trade name: Seast S, manufactured by Tokai Carbon Co., Ltd.) | 40 |
| | calcium carbonate (trade name: Silver W, Shiraishi Kogyo Kaisha, Ltd.) | 15 |
| | paraffin oil (trade name: PW380, manufactured by | 20 |

TABLE 6-continued

| | Material | Parts by mass |
|---|---|---|
| | Idemitsu Kosan Co., Ltd.) | |
| Component (2) | resin particle b6 | 20 |
| | sulfur (vulcanizing agent) | 1 |
| | dibenzothiazyl sulfide (DM) (trade name: Nocceler DM, manufactured by Ouchi Shinko Chemical Industrial Co., Ltd., vulcanization accelerator) | 1 |

Production Examples c10, c11, c14, and c15

Conductive rubber compositions c10, c11, c14, and c15 were produced as in Production Example c1, except that the type and the amount of parts of the resin particles were changed as described in Table 7.

Production Examples c12 and c13

Conductive rubber compositions c12 and c13 were produced as in Production Example c1, except that acrylonitrile-butadiene rubber was changed to butadiene rubber BR ("JSR BR01", trade name, manufactured by JSR Corp.), the amount of carbon black was changed to 30 parts by mass, and the type and the amount of parts of the resin particles were changed as described in Table 8.

Production Example c16

To 75 parts by mass of chloroprene rubber (trade name: Shoprene WRT, manufactured by Showa Denko K.K.), other three materials described in the row of Component (1) in Table 8 were added. The mixture was kneaded for 15 minutes with a closed mixer adjusted at 50° C. Three materials described in the row of Component (2) in Table 7 were added to the mixture. Subsequently, the mixture was kneaded for 15 minutes with a two-roll mill cooled to 20° C., thereby producing conductive rubber composition c18.

TABLE 7

| | Material | Parts by mass |
|---|---|---|
| Component (1) | chloroprene rubber (trade name: Shoprene, manufactured by Showa Denko K.K.) | 75 |
| | NBR (trade name: Nipol 401LL, manufactured by ZEON Corporation) | 25 |
| | hydrotalcite (trade name: DHT-4A-2, manufactured by Kyowa Chemical Industry Co., Ltd.) | 3 |
| | quarternary ammonium salt (trade name: KS-555, manufactured by Kao Corporation) | 5 |
| Component (2) | resin particle b11 | 3 |
| | sulfur (vulcanizing agent) | 0.5 |
| | ethylenethiourea (trade name: Accel, manufactured by Kawaguchi Chemical Industry Co., Ltd., vulcanization accelerator) | 1.4 |

TABLE 8

| Conductive rubber composition | Binder rubber | Resin particles | Resin particles: Material | Resin particles: Particle diameter (μm) | Resin particles: Parts by mass |
|---|---|---|---|---|---|
| c1 | NBR | b1 | acrylonitrile-methacrylonitrile-methyl methacrylate | 12 | 12 |
| c2 | NBR | b2 | acrylonitrile-methacrylonitrile-methyl methacrylate | 50 | 12 |
| c3 | NBR | b1 | acrylonitrile-methacrylonitrile-methyl methacrylate | 12 | 20 |
| c4 | NBR | b1 | acrylonitrile-methacrylonitrile-methyl methacrylate | 12 | 5 |
| c5 | NBR | b3 | acrylonitrile-methacrylonitrile-methyl methacrylate | 60 | 15 |
| c6 | NBR | b4 | acrylonitrile-methacrylonitrile-methyl methacrylate | 10 | 3 |
| c7 | NBR | b5 | acrylonitrile-methacrylonitrile-methyl methacrylate | 40 | 5 |
| c8 | NBR | b6 | acrylonitrile-methacrylonitrile-methyl methacrylate | 15 | 20 |
| c9 | SBR | b5 | acrylonitrile-methacrylonitrile-methyl methacrylate | 40 | 20 |
| c10 | NBR | b3 | acrylonitrile-methacrylonitrile-methyl methacrylate | 60 | 15 |
| c11 | NBR | b6 | acrylonitrile-methacryloitrile-methyl methacrylate | 15 | 5 |
| c12 | BR | b9 | methyl methacrylate-acrylamide | 10 | 10 |
| c13 | BR | b9 | methyl methacrylate-acrylamide | 10 | 5 |
| c14 | NBR | b7 | methacrylonitrile-methyl methacrylate | 25 | 20 |
| c15 | NBR | b8 | acrylamide-methacrylamide | 45 | 12 |
| c16 | CR/NBR | b10 | acrylamide | 8 | 3 |

Production Examples of charging members T1 to T19

Production Example T1

Production of Electro-Conductive Substrate

A thermosetting adhesive containing 10% by mass carbon black was applied to a stainless-steel rod having a diameter of 6 mm and a length of 252.5 mm and dried to provide an electro-conductive substrate.

Production of Charging Member

The outer peripheral portion of the electro-conductive substrate serving as a central shaft was coated with conductive rubber composition c1 using an extruder equipped with a cross-head, thereby providing a rubber roller. The thickness of the rubber composition coating was adjusted to 1 mm. After the roller was heated in a hot-air oven at 160° C. for 1 hour, both end portions of the rubber composition coating were removed in such a manner that the length was 224.2 mm. Furthermore, secondary heating was performed at 160° C. for 1 hour, thereby producing a roller having a 2-mm-thick preliminary coating layer composed of the rubber composition.

The peripheral surface of the roller was ground with a cylindrical grinding machine of a plunge cutting system. As the grinding wheel, a vitrified grinding wheel was used. The abrasive grains were green silicon carbide (GC) particles having a particle size of 100 meshes. The number of revolutions of the roller was 350 rpm. The number of revolutions of the grinding wheel was 2050 rpm. The rotational direction of the roller was the same as the rotational direction of the grinding wheel (follow-up direction). The rate of cut was 20 mm/min. The spark-out time (the time at a cut of 0 mm) was 0 second. Grinding was performed to produce elastic member e1. The thickness of the resin layer was adjusted to 1.5 mm. The crown height was adjusted to 110 μm.

The surface of elastic member e1 was subjected to electron beam irradiation under the following conditions (described in Table 9), thereby producing an elastic roller.

The electron beam irradiation was performed with an electron beam irradiation apparatus (manufactured by Iwasaki Electric Co., Ltd.) operable at a maximum acceleration voltage of 150 kV and a maximum electron current of 40 mA. The apparatus was purged with nitrogen gas before irradiation. Regarding treatment conditions, the acceleration voltage was 80 kV, the electron current was 20 mA, the processing speed was 2.04 m/min, and the oxygen concentration was 100 ppm. The apparatus constant of the electron beam irradiation apparatus was 20.4 at an acceleration voltage of 80 kV. The dose was calculated from the formula (31) and found to be 200 kGy.

The elastic roller had an electro-conductive resin layer on a surface thereof, the electro-conductive resin layer including protrusions derived from edges of openings of bowl-shaped resin particles and concavities derived from the openings of the bowl-shaped resin particles. The elastic roller was defined as charging member T1. Table 10 describes the evaluation results of the physical properties of the charging member.

Production Example T2

Elastic member e2 was produced as in Production example T1, except that heating conditions of the circulating hot air dryer was changed as described in Table 9. Elastic member e2 was heated at 200° C. for 30 minutes with a circulating hot air dryer. As with Production example T1, electron beam irradiation was performed to provide charging member T2. Table 10 describes the evaluation results of the physical properties of the charging member.

Production Examples T3 to T15

Charging members T3 to T15 were produced as in Production Example T2, except that the type of the conductive rubber composition, the grinding conditions, the elastic member, heating conditions of the circulating hot air dryer, and electron beam irradiation conditions were changed as diffusion index Table 9. Table 10 describes the evaluation results of the physical properties of the charging members. In Table 9, blanks, where no value is described, indicates no condition was provided.

Production Example T16 and T17

Charging members were produced as in Production example T2, except that the type of the conductive rubber composition and the grinding conditions were changed. The resulting charging members were subjected to ultraviolet irradiation to produce charging members T16 and T17. The ultraviolet irradiation was performed with a low-pressure mercury lamp (manufactured by Harison Toshiba Lighting Corporation) in such a manner that the integral light quantity of ultraviolet ray having a wavelength of 254 nm was 9000 mJ/cm$^2$. Table 10 describes the evaluation results of the physical properties of the charging members.

Production Examples T18 and T19

Charging members T18 and T19 were produced as in Production Example T2, except that the type of the conductive rubber composition, the grinding conditions, the elastic member, heating conditions of the circulating hot air dryer, and electron beam irradiation conditions were changed as diffusion index Table 9. Table 10 describes the evaluation results of the physical properties of the charging members.

Evaluation Method for Charging Member and Resin Particles

Electrical Resistance of Charging Member

Figure 5:
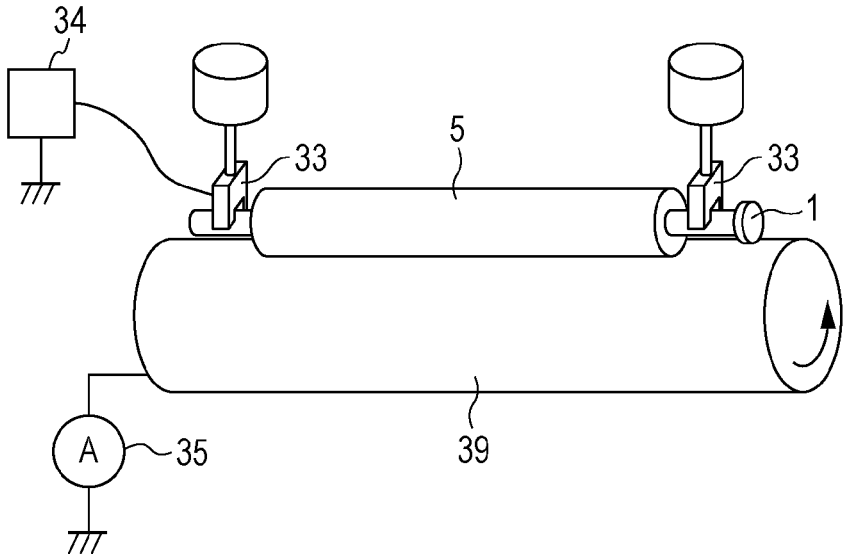
FIG. 5 illustrates a measuring apparatus configured to measure electrical resistance of a charging member of the present invention.

FIG. 5 is a measuring apparatus configured to measure electrical resistance of a charging member. By applying a load to both ends of the electro-conductive substrate 1 by bearings 33, the charging member 5 is brought into contact with a cylindrical metal 39 having the same curvature radius as the electrophotographic photosensitive member in such a manner that the charging member 5 is in parallel with the cylindrical metal 39. In this state, a DC voltage of −200 V is applied thereto from a stabilized power source 34 while the cylindrical metal 39 is rotated by means of a motor (not illustrated) to rotate the contacted charging member 5. At this point, a current flowing through the charging member is measured with an ammeter 35, and the electrical resistance of the charging member is calculated. The load is set to be 4.9 N at each end portion. The metal cylinder has a diameter of 30 mm and is rotated at a circumferential velocity of 45 mm/sec.

Before measurement, the charging member is allowed to stand at a temperature of 23° C. and a relative humidity of 50% for 24 hours or more. The measurement is performed with the measuring apparatus placed in the same environment.

Surface Roughness

The ten point height of irregularities Rzjis, the arithmetical mean roughness Ra, and the average spacing of irregularities Sm are measured according to JIS B 0601-1994 surface roughness with a surface profile analyzer (trade name: SE-3500, manufactured by Kosaka Laboratory Ltd). Each of the ten point height of irregularities Rzjis and the arithmetical mean roughness Ra is an average value of values measured at freely-selected 6 spots of a charging member. The average spacing of irregularities Sm is calculated as follows: The spacings of irregularities are measured at 10 points for each of the freely-selected 6 spots. The average value of the spacings is calculated. The average of the average values at the 6 spots is calculated. In the case of measurement, the cut-off value is set to be 8 mm, and the evaluation length is set to be 0.8 mm.

Shape Measurement for Bowl-Shaped Resin Particles

The measurement is performed at a total of 10 measurement points: 5 spots in the longitudinal direction, which are located at the central portion of a roller in the longitudinal direction, positions 45 mm away from the central portion toward both ends, and positions 90 mm away from the central portion toward both ends, and 2 points (phase 0° and 180°) in the circumferential direction for each spot. The electro-conductive resin layer is cut out at these measurement points at intervals of 20 nm over the length of 500 μm with a focused ion beam processing observation instrument (trade name: FB-2000C; manufactured by Hitachi Ltd.), and their sectional images are photographed. The sectional images are combined to calculate stereoscopic images of the bowl-shaped resin particles. From the stereoscopic images, the maximum diameter 58 as illustrated in FIG. 3 and the minimum diameter 74 of openings illustrated in FIGS. 4A to 4E are calculated. The thickness of the shell of the bowl-shaped resin particle is measured at freely-selected 5 spots of the bowl-shaped resin particle on the basis of the stereoscopic images. These measurement operations are performed for 10 resin particles in the field of view. The average of a total of 100 measurement values is calculated. Thereby, the "maximum diameter", the "minimum diameter of opening", and the "shell thickness" are determined. Regarding the measurement of the shell thickness, the thickness of a thickest portion of the shell is two or less times the thickness of a thinnest portion for each bowl-shaped resin particle. That is, it was confirmed that the shell thickness is substantially uniform.

Measurement of Difference in Height Between Top of Protrusion and Bottom of Concavity on Surface of Charging Member The charging member surface is observed on a laser microscope (trade name: LXM5 PASCAL; manufactured by Carl Zeiss, Inc.) in the visual field of 0.5 mm in length and 0.5 mm in width. A laser beam is scanned over the X-Y plane within the visual field to obtain two-dimensional image data. Furthermore, the focus is shifted in the Z direction. The foregoing scanning is repeated to obtain three-dimensional image data. It is confirmed that the resin particles have the concavities derived from the openings of the bowl-shaped resin particles and the protrusions derived from the edges of the openings of the bowl-shaped resin particles. Furthermore, differences 57 in height between tops 55 of the protrusions 54 and bottoms 56 of the concavity are calculated. Such an operation is performed for two bowl-shaped resin particles present within the visual field. Similar measurement is made at 50 spots in the longitudinal direction of the charging member, and an average value of 100 measured values in total is calculated. This value is defined as the "difference in height".

Method for Measuring Average Particle Diameter of Resin Particles

The average particle diameter of a powder of resin particles is measured with COULTER COUNTER Multisizer. Specifically, 0.1 to 5 mL of a surfactant (alkylbenzene sulfonate) is added to 100 to 150 mL of an electrolyte solution. To the mixture, 2 to 20 mg of resin particles are added. The electrolyte liquid containing resin particles suspended therein is subjected to dispersion treatment for 1 to 3 minutes with an ultrasonic disperser. A particle size distribution is measured on a volume basis with COULTER COUNTER Multisizer using 100 μm of an aperture. The volume-average particle diameter is determined by computer processing from the resulting particle size distribution. This is defined as the average particle diameter of the resin particles.

Measurement of Restoring Velocity in Elastic Deformation of Charging Member

Measurement was performed with Picodentor HM500 (trade name, manufactured by Fisher Instruments) according to ISO 14577. As a penetrator, a square-based pyramidal diamond penetrator with a face angle of 136° (Vickers pyramid) was used. Measurement is performed at the central portion and both end portions in the longitudinal direction (positions 90 mm away from the central portion toward both ends). The average value is defined as the restoring velocity of the present invention.

The measurement includes a penetration step of penetrating the penetrator to a predetermined depth at a predetermined velocity (hereinafter, referred to as a "penetration step") and an unloading step of removing a load from a predetermined depth of penetration at a predetermined velocity (hereinafter, referred to as an "unloading step"). The restoring velocity from elastic deformation was calculated from the resulting load-displacement curve as illustrated in FIG. 7. A method for calculating the restoring velocity will be described below.

Measurement was performed under two conditions described below. FIG. 7 is a graph illustrating an example of a load-displacement curve under <Condition 2> at t=100 μm.

Condition 1: Measurement of Restoring Velocity on Surface

Penetration Step

Maximum depth of penetration=10 μm

Time of penetration=20 seconds

To enable the penetrator to penetrate to the maximum depth of penetration, the maximum load Fmax needs to be a sufficiently large value. In this measurement, the maximum load was set to 10 mN.

Unloading Step

Minimum load=0.005 mN

Unloading time=1 second

The unloading was continued until the load on the penetrator reached the minimum load.

The restoring velocity v in elastic deformation was calculated from the following formula using the displacement (=restoring length L) of the penetrator 0.1 seconds after the initiation of unloading in the unloading step:

Restoring velocity $v=L/0.1$

Condition 2: Measurement of Restoring Velocity at predetermined depth t μm

Penetration step

Maximum depth of penetration (predetermined depth t)=20, 30, 50, 100 μm

Time of penetration=20 seconds

To enable the penetrator to penetrate to the maximum depth of penetration, the maximum load needs to be a sufficiently large value. In this measurement, the maximum load was set to 300 mN.

Unloading Step

Minimum load=0.005 mN

Unloading time=(maximum depth of penetration)/10 sec

The unloading was continued until the load on the penetrator reached the minimum load. The unloading time is determined by the maximum depth of penetration in the penetration step. For example, when the maximum depth of penetration t is 20 μm, the unloading time is 2 seconds. This is to equalize the unloading velocities under Conditions 1 and 2. The calculation of the restoring velocity v in elastic deformation was conducted in the same way as in Condition 1.

TABLE 9

| | | Conductive | Grinding conditions | | Heat treatment conditions | | Electron beam irradiation conditions | | | |
|---|---|---|---|---|---|---|---|---|---|---|
| Charging member No. | Elastic member No. | rubber composition | Cutting rate (mm/min) | Spark out (sec) | Temperature (° C.) | Time (min) | Accelerating voltage (kV) | Electron current (mA) | Treatment rate (m/min) | Dose (kGy) |
| T1 | e1 | c1 | 20 | 0 | — | — | 100 | 20 | 1.00 | 200 |
| T2 | e2 | c1 | 20 | 0 | 200 | 30 | 100 | 20 | 1.00 | 200 |
| T3 | e3 | c3 | 20 | 0 | — | — | 120 | 20 | 1.00 | 200 |
| T4 | e4 | c3 | 20 | 0 | — | — | 80 | 20 | 2.04 | 200 |
| T5 | e5 | c4 | 20 | 0 | 200 | 5 | — | — | — | — |
| T6 | e6 | c3 | 20 | 0 | 180 | 10 | — | — | — | — |
| T7 | e7 | c7 | 20 | 0 | — | — | 100 | 20 | 1.00 | 200 |
| T8 | e8 | c15 | 20 | 1 | 200 | 15 | — | — | — | — |
| T9 | e9 | c5 | 20 | 0 | — | — | 100 | 20 | 1.00 | 200 |
| T10 | e10 | c8 | 20 | 0 | 200 | 30 | — | — | — | — |
| T11 | e11 | c11 | 20 | 0 | — | — | 100 | 20 | 1.00 | 200 |
| T12 | e12 | c2 | 20 | 0 | 200 | 60 | — | — | — | — |
| T13 | e13 | c9 | 20 | 0 | — | — | 120 | 20 | 1.00 | 200 |
| T14 | e14 | c14 | 20 | 0 | — | — | 100 | 20 | 1.00 | 200 |
| T15 | e15 | c12 | 20 | 0 | — | — | — | — | — | — |
| T16 | e16 | c13 | 20 | 0 | — | — | — | — | — | — |
| T17 | e17 | c6 | 20 | 0 | — | — | — | — | — | — |
| T18 | e18 | c10 | 20 | 0 | 200 | 15 | 120 | 20 | 1.00 | 200 |
| T19 | e19 | c16 | 10 → 0.1 | 10 | — | — | — | — | — | — |

TABLE 10

| | | | | | Shape measurement (μm) | | | Details of uneven shape | | | | | | |
|---|---|---|---|---|---|---|---|---|---|---|---|---|---|---|
| Charging member No. | Electrical resistance (Ω) | Surface roughness (μm) Rzjis | Ra | RSm | Maximum diameter | Minimum diameter of opening portion | Thickness of shell | Difference in height (μm) | (Maximum diameter)/(difference in height) | (Maximum diameter)/(minimum diameter of opening portion) | Restoring rate (N/m) Surface | Predetermined depth t 20 μm | 30 μm | 50 μm |
| T1 | $2.23 \times 10^5$ | 35 | 4.8 | 81 | 50 | 32 | 0.5 | 38 | 1.32 | 1.56 | 6.8 | 4.5 | 3.5 | 2.8 |
| T2 | $2.80 \times 10^5$ | 36 | 4.9 | 82 | 51 | 31 | 0.5 | 39 | 1.31 | 1.65 | 10.1 | 4.8 | 3.5 | 2.8 |
| T3 | $2.51 \times 10^5$ | 37 | 5.5 | 68 | 51 | 32 | 0.5 | 38 | 1.34 | 1.59 | 7.3 | 4.8 | 3.5 | 2.8 |
| T4 | $2.62 \times 10^5$ | 38 | 5.8 | 78 | 50 | 31 | 0.5 | 37 | 1.35 | 1.61 | 5.4 | 4.1 | 3.5 | 2.8 |
| T5 | $2.72 \times 10^5$ | 30 | 4.8 | 95 | 47 | 30 | 0.4 | 32 | 1.47 | 1.57 | 6.8 | 4.1 | 3 | 2.5 |
| T6 | $2.42 \times 10^5$ | 37 | 5.8 | 75 | 51 | 32 | 0.5 | 38 | 1.34 | 1.59 | 5.5 | 4.2 | 3 | 2.5 |
| T7 | $3.91 \times 10^5$ | 49 | 4.3 | 150 | 89 | 65 | 0.3 | 51 | 1.75 | 1.37 | 6.8 | 4.6 | 3.4 | 2.6 |
| T8 | $2.50 \times 10^6$ | 48 | 4.8 | 100 | 90 | 45 | 2.9 | 51 | 1.76 | 2.00 | 6.5 | 4.3 | 3.6 | 2.4 |
| T9 | $5.82 \times 10^5$ | 72 | 6.8 | 120 | 120 | 100 | 1.2 | 75 | 1.60 | 1.20 | 5.9 | 4.1 | 3.2 | 2.2 |
| T10 | $5.10 \times 10^5$ | 20 | 4.2 | 63 | 30 | 14 | 0.8 | 21 | 1.43 | 2.14 | 7.0 | 4.8 | 3.7 | 2.8 |
| T11 | $5.12 \times 10^5$ | 18 | 3.7 | 73 | 28 | 13 | 0.8 | 20 | 1.40 | 2.15 | 7.2 | 5 | 3.6 | 2.7 |
| T12 | $4.50 \times 10^5$ | 61 | 6.4 | 100 | 100 | 60 | 0.8 | 59 | 1.69 | 1.67 | 6.8 | 4.8 | 3.5 | 2.8 |
| T13 | $4.03 \times 10^5$ | 53 | 4.8 | 55 | 86 | 45 | 0.5 | 57 | 1.51 | 1.91 | 9.8 | 4.7 | 3.7 | 2.8 |
| T14 | $4.00 \times 10^5$ | 45 | 5.9 | 40 | 58 | 32 | 0.4 | 48 | 1.21 | 1.81 | 8.8 | 4.5 | 3.2 | 2.0 |
| T15 | $3.76 \times 10^5$ | 15 | 3.0 | 130 | 21 | 14 | 2.7 | 16 | 1.31 | 1.50 | 0.9 | 1 | 1 | 0.9 |
| T16 | $3.54 \times 10^5$ | 12 | 2.8 | 145 | 20 | 12 | 2.8 | 13 | 1.54 | 1.67 | 0.8 | 0.9 | 0.9 | 0.8 |
| T17 | $2.57 \times 10^5$ | 9 | 2.1 | 153 | 17 | 13 | 0.1 | 11 | 1.55 | 1.31 | 0.9 | 1 | 1 | 0.9 |
| T18 | $6.00 \times 10^5$ | 75 | 7.0 | 110 | 125 | 103 | 1.3 | 78 | 1.60 | 1.21 | 9.8 | 4.8 | 3.6 | 2.2 |
| T19 | $9.02 \times 10^5$ | 55 | 4.3 | 180 | 50 | 31 | 0.5 | 35 | 1.43 | 1.61 | 1.0 | 0.9 | 1.0 | 0.9 |

Example 1

A monochrome laser printer ("LBP6300" (trade name)), which was an image-forming apparatus having a structure illustrated in FIG. 6, manufactured by CANON KABUSHIKI KAISHA was modified so as to have a process speed of 370 mm/sec. Furthermore, a voltage was applied to a charging member from the outside. The voltage applied was an alternating voltage. The peak-to-peak voltage (Vpp) was 1600 V. The frequency (f) was 1350 Hz. The direct voltage (Vdc) was −560 V. Images were formed at a resolution of 600 dpi. As a process cartridge, a process cartridge for the printer was used.

All toner was removed from the process cartridge, and the process cartridge was cleaned. Toner 1 produced in Production example A1 was charged in a weight equal to the weight of the toner removed from the process cartridge.

A charging member included as an accessory of the process cartridge was removed. Charging member T1 produced in Production example T1 was attached to the process cartridge. The charging member was brought into contact with an electrophotographic photosensitive member at a spring-loaded pressing force of 4.9 N at each end portion, i.e., at 9.8 N at both end portions in total.

After the process cartridge was allowed to stand in a low-temperature and low-humidity environment (7.5° C./30% RH environment) for 24 hours, the evaluation of cleaning properties was performed.

Regarding the formation of images, horizontal-line images of 2 dots in width and 186 dots in space in the direction perpendicular to the rotational direction of the electrophotographic photosensitive member were formed on 10,000 sheets. The image formation on 10,000 sheets was performed under conditions such that the rotation of the printer was stopped every 2 sheets for 3 seconds. A 3000 sheets/day printout test was performed on days 1 to 3. A 1000 sheets/day printout test was performed on day 4.

Evaluation of the cleaning properties was performed on:

(a) the horizontal-line images formed from immediately after the start of horizontal-line image printing up to the printing of 1000 sheets (Evaluation 1 in Table 14), (b) the horizontal-line images formed after the 3000 sheet durability test and from immediately after the start of day 2 of the printout test up to the printing of 1000 sheets (Evaluation 2 in the table), (c) the horizontal-line images formed after the 6000 sheet durability test and from immediately after the start of day 3 of the printout test up to the printing of 1000 sheets (Evaluation 3 in Table 14), and (d) the horizontal-line images formed after the 9000 sheet durability test and from immediately after the start of day 4 of the printout test up to the printing of 1000 sheets (Evaluation 4 in Table 14).

The conditions on days 2 and 3 are the harshest conditions for evaluating the cleaning properties. This is because aggregated toner, which is formed through a transfer step, is most likely to occur, compared with the first or last day of the image formation.

The resulting horizontal-line images on 1000 sheets were visually evaluated. The cleaning properties were evaluated according to criteria described in Table 11. As described above, the occurrence of the cleaning failure is recognized as a longitudinal streak image on the horizontal-line image.

TABLE 11

| Rank | Evaluation result |
|---|---|
| A | No longitudinal streak image is observed. |
| B | A faint longitudinal streak image is observed on each of the images on as few as less than 10 sheets. |
| C | Although a faint longitudinal streak image is observed on each of the images on 10 or more sheets, there is no problem for practical use. |
| D | The longitudinal streak images are conspicuous, and a reduction in image quality is observed. |

Regarding the evaluation of the smudge on the charging member, after the 3000 sheet durability test of the horizontal-line image printing, halftone images (images drawn in horizontal lines of 1 dot in width and 2 dots in space in the direction perpendicular to the rotational direction of the electrophotographic photosensitive member) were formed to make evaluation (Evaluation 5 in Table 13). The halftone images were formed after the 6000 sheet durability test (Evaluation 6 in Table 13), after the 9000 sheet durability test (Evaluation 7 in Table 13), and after the 10,000 sheet durability test (Evaluation 8 in Table 13) in the same way as above. The halftone images were visually observed. Whether the dot-like image caused by the smudge on the charging member was recognized in the images or not is evaluated according to criteria described in Table 12.

TABLE 12

| Rank | Evaluation result |
|---|---|
| A | No dot-like image is observed. |
| B | A faint dot-like image is observed. |
| C | Although the dot-like images are observed with a pitch corresponding to the charging member, there is no problem for practical use. |
| D | The dot-like images are conspicuous, and a reduction in image quality is observed. |

Examples 2 to 34

Evaluations were performed as in Example 1, except that the combination of the toner and the charging member was changed as diffusion index Table 13. Table 13 describes the results.

Comparative Examples 1 to 12

Evaluations were performed as in Example 1, except that the combination of the toner and the charging member was changed as diffusion index Table 13. Table 13 describes the results. In each of comparative examples, the longitudinal streak image was markedly observed. The image quality was reduced.

TABLE 13

| | | | Evaluation of cleaning properties | | | | Evaluation of smudge | | | |
|---|---|---|---|---|---|---|---|---|---|---|
| | Toner | Charging member | Evaluation 1 | Evaluation 2 | Evaluation 3 | Evaluation 4 | Evaluation 5 | Evaluation 6 | Evaluation 7 | Evaluation 8 |
| Example 1 | Toner A1 | Charging member T1 | A | A | A | A | A | A | A | A |
| Example 2 | Toner A7 | Charging member T2 | A | A | A | A | A | A | A | A |
| Example 3 | Toner A10 | Charging member T3 | A | A | A | A | A | A | A | A |
| Example 4 | Toner A6 | Charging member T2 | A | A | A | A | A | A | A | A |
| Example 5 | Toner A11 | Charging member T3 | A | A | A | A | A | A | A | A |
| Example 6 | Toner A9 | Charging member T5 | A | A | A | A | A | A | A | A |
| Example 7 | Toner A6 | Charging member T9 | A | A | A | A | A | A | A | A |
| Example 8 | Toner A11 | Charging member T9 | A | A | A | A | A | A | A | A |
| Example 9 | Toner A1 | Charging member T9 | A | A | A | A | A | A | A | A |
| Example 10 | Toner A8 | Charging member T10 | A | A | A | A | A | A | A | A |
| Example 11 | Toner A5 | Charging member T11 | A | A | A | A | A | A | A | A |
| Example 12 | Toner A11 | Charging member T12 | A | A | A | A | A | A | A | A |
| Example 13 | Toner A6 | Charging member T12 | A | A | A | A | A | A | A | A |
| Example 14 | Toner A8 | Charging member T13 | A | A | A | A | A | A | A | A |
| Example 15 | Toner A5 | Charging member T14 | A | A | A | A | A | A | A | A |
| Example 16 | Toner A5 | Charging member T15 | A | A | A | A | A | A | A | A |
| Example 17 | Toner A1 | Charging member T15 | A | A | A | A | A | A | A | A |
| Example 18 | Toner A4 | Charging member T4 | A | B | A | A | A | A | A | B |
| Example 19 | Toner A2 | Charging member T6 | A | B | A | A | A | A | A | B |
| Example 20 | Toner A2 | Charging member T7 | A | B | B | A | A | A | B | B |
| Example 21 | Toner A4 | Charging member T8 | A | B | B | A | A | A | B | B |
| Example 22 | Toner A4 | Charging member T13 | A | B | B | A | A | A | B | B |
| Example 23 | Toner A11 | Charging member T15 | A | B | B | A | A | A | B | B |
| Example 24 | Toner A6 | Charging member T15 | A | B | B | A | A | A | B | B |
| Example 25 | Toner A3 | Charging member T17 | A | B | B | A | A | B | B | B |
| Example 26 | Toner A2 | Charging member T18 | A | B | C | A | A | B | B | C |
| Example 27 | Toner A4 | Charging member T18 | A | B | C | A | A | B | C | C |
| Example 28 | Toner A2 | Charging member T16 | A | C | B | A | A | B | B | C |
| Example 29 | Toner A4 | Charging member T16 | A | C | B | A | A | B | B | C |
| Example 30 | Toner A11 | Charging member T16 | A | C | B | A | A | B | B | C |
| Example 31 | Toner A11 | Charging member T17 | A | C | C | A | A | B | B | C |
| Example 32 | Toner A2 | Charging member T17 | A | C | C | A | A | B | C | C |
| Example 33 | Toner A4 | Charging member T17 | A | C | C | A | A | C | C | C |
| Example 34 | Toner A12 | Charging member T15 | A | B | C | A | A | C | C | C |
| Comparative Example 1 | Toner a13 | Charging member T17 | B | C | D | B | B | B | C | D |
| Comparative Example 2 | Toner a14 | Charging member T17 | B | D | D | B | B | C | D | D |
| Comparative Example 3 | Toner a15 | Charging member T17 | B | D | D | B | B | C | D | D |

TABLE 13-continued

| | Toner | Charging member | Evaluation of cleaning properties | | | | Evaluation of smudge | | | |
|---|---|---|---|---|---|---|---|---|---|---|
| | | | Evaluation 1 | Evaluation 2 | Evaluation 3 | Evaluation 4 | Evaluation 5 | Evaluation 6 | Evaluation 7 | Evaluation 8 |
| Comparative Example 4 | Toner a16 | Charging member T17 | B | D | D | B | B | C | D | D |
| Comparative Example 5 | Toner a17 | Charging member T17 | C | D | D | B | B | C | D | D |
| Comparative Example 6 | Toner a18 | Charging member T17 | C | D | D | C | B | C | D | D |
| Comparative Example 7 | Toner a13 | Charging member T19 | D | D | D | D | B | C | D | D |
| Comparative Example 8 | Toner a14 | Charging member T19 | D | D | D | D | B | C | D | D |
| Comparative Example 9 | Toner a15 | Charging member T19 | D | D | D | D | B | C | D | D |
| Comparative Example 10 | Toner a16 | Charging member T19 | D | D | D | D | B | C | D | D |
| Comparative Example 11 | Toner a17 | Charging member T19 | D | D | D | D | B | C | D | D |
| Comparative Example 12 | Toner a18 | Charging member T19 | D | D | D | D | D | D | D | D |

According to the present invention, it is possible to inhibit the occurrence of a cleaning failure and the formation of a longitudinal streak image due to the cleaning failure.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of International Patent Application No. PCT/JP2013/067712, filed Jun. 27, 2013, which is hereby incorporated by reference herein in its entirety.

The invention claimed is:

1. An image-forming apparatus comprising:

a photosensitive member, charging means for charging the photosensitive member with a charging member, exposure means for forming an electrostatic latent image on a surface of the charged photosensitive member, developing means for supplying the photosensitive member on which the electrostatic latent image is formed with a toner to form a toner image on the surface of the photosensitive member, and cleaning means for recovering a residual toner before the charging means, wherein:

the charging member comprises an electro-conductive substrate and an electro-conductive resin layer, the electro-conductive resin layer comprises a binder resin C and bowl-shaped resin particles, and a surface of the charging member has concavities derived from openings of the bowl-shaped resin particles, and protrusions derived from edges of the openings of the bowl-shaped resin particles, and wherein:

the toner comprises:

toner particles, each of which contains a binder resin T and a colorant, and inorganic fine particles, the inorganic fine particles are silica fine particles, the toner contains the silica fine particles in an amount of 0.40 parts by mass or more and 1.50 parts by mass or less based on 100 parts by mass of the toner particles, the silica fine particles have been treated with 15.0 parts by mass or more and 40.0 parts by mass or less of a silicone oil based on 100 parts by mass of a silica raw material, the fixation ratio (%) of the silicone oil based on the amount of carbon is 70% or more, and the coverage ratio X1 of a surface of the toner by the silica fine particles, as determined by X-ray photoelectron spectrometer (ESCA), is 50.0 area % or more and 75.0 area % or less, and when a theoretical coverage ratio of the toner by the silica fine particles is X2, a diffusion index represented by the following formula 1 satisfies the following formula 2:

$$\text{diffusion index}=X1/X2 \quad \text{(formula 1)}$$

$$\text{diffusion index}\geq -0.0042\times X1+0.62, \quad \text{(formula 2)}$$

wherein X2 is defined by the following formula 4:

$$X2=3^{1/2}/(2\pi)\times(dt/da)\times(\rho t/\rho a)\times C\times 100, \quad \text{(formula 4)}$$

where da is the number-average particle diameter of the silica fine particles, dt is the weight-average particle diameter of the toner, ρa is the true specific gravity of the silica fine particles, ρt is the true specific gravity of the toner, and C is the mass of the silica fine particles/the mass of the toner, and wherein the bowl-shaped resin particle has an opening portion and a roundish concavity defined by a shell.

2. The image-forming apparatus according to claim 1, wherein a ten-point height of irregularities Rzjis of the surface of the charging member is 15 μm or more and 75 μm or less, and an arithmetical mean roughness Ra of the surface of the charging member is 3.0 μm or more and 7.0 μor less.

3. The image-forming apparatus according to claim 1, wherein a restoring velocity of the charging member decreases from the surface of the charging member in an inward direction thereof.

4. A process cartridge detachably attachable to the image-forming apparatus according to claim 1, integrally supporting the charging means, the photosensitive member, and the cleaning means.

* * * * *